US010483680B2

(12) United States Patent
Newman

(10) Patent No.: US 10,483,680 B2
(45) Date of Patent: Nov. 19, 2019

(54) DECORATIVE CONCEALED OUTLET DEVICE AND SYSTEM

(71) Applicant: Talonted Group, Inc., Jupiter, FL (US)

(72) Inventor: Lee Newman, Jupiter, FL (US)

(73) Assignee: TALONTED GROUP, INC., Jupiter, FL (US)

( * ) Notice: Subject to any disclaimer, the term of this patent is extended or adjusted under 35 U.S.C. 154(b) by 0 days.

(21) Appl. No.: 16/028,810

(22) Filed: Jul. 6, 2018

(65) Prior Publication Data

US 2019/0013612 A1 Jan. 10, 2019

Related U.S. Application Data

(60) Provisional application No. 62/694,573, filed on Jul. 6, 2018, provisional application No. 62/529,920, filed on Jul. 7, 2017.

(51) Int. Cl.
*H01R 13/447* (2006.01)
*H01R 13/443* (2006.01)

(52) U.S. Cl.
CPC ..... *H01R 13/447* (2013.01); *H01R 13/443* (2013.01)

(58) Field of Classification Search
CPC ..... H01R 13/447; H01R 13/443
USPC ..... 439/148, 135, 149
See application file for complete search history.

(56) References Cited

U.S. PATENT DOCUMENTS

| | | | | | |
|---|---|---|---|---|---|
| 5,285,014 | A * | 2/1994 | Gilchrist | H01R 13/443 | 174/67 |
| 5,375,728 | A * | 12/1994 | West | H01R 13/443 | 174/488 |
| 5,571,995 | A * | 11/1996 | Pierce | H01R 13/443 | 174/67 |
| 7,229,322 | B2 * | 6/2007 | Bangert | H01R 25/003 | 439/13 |
| 8,158,885 | B2 * | 4/2012 | Eastin | H02G 3/14 | 174/66 |
| 8,212,146 | B1 | 7/2012 | Moore | | |
| 2013/0269273 | A1 * | 10/2013 | Mayo | E04F 13/0862 | 52/391 |

* cited by examiner

*Primary Examiner* — Travis S Chambers
(74) *Attorney, Agent, or Firm* — Sheridan Ross P.C.

(57) ABSTRACT

Methods, devices, and systems are provided that conceal an outlet in a decorated environment. The decorative concealed outlet device includes a frame configured to receive a decorative element matching a decorated surface of the decorated environment. The frame includes retaining features that engage with ports of the outlet and allow the device to be selectively removed and replaced from an outlet concealed position to an outlet exposed position, and vice versa. The device acts as a camouflaged protective wall outlet cover capable of hiding a wall outlet from view by including like materials to that of the surroundings, such as tile, attached to the front of the cover. The cover can prevent risk of electric shock while hiding or substantially minimizing the appearance of a wall outlet. The cover can be removed at any time so that the wall outlet can still operate as a function outlet.

17 Claims, 22 Drawing Sheets

DECORATIVE CONCEALED OUTLET DEVICE AND SYSTEM

CROSS REFERENCE TO RELATED APPLICATIONS

The present application claims the benefit of and priority, under 35 U.S.C. § 119(e), to U.S. Provisional Application Ser. Nos. 62/529,920, filed on Jul. 7, 2017, entitled "CAMOUFLAGED PROTECTIVE COVER ACCESSORY TO HIDE WALL OUTLET"; and 62/694,573, filed on Jul. 6, 2018, entitled "HINGED DECORATIVE CONCEALED OUTLET DEVICE AND SYSTEM." The entire disclosures of the applications listed above are hereby incorporated herein by reference, in their entirety, for all that they teach and for all purposes.

FIELD

The present disclosure is generally directed to methods and devices to conceal or disguise outlets, and in particular to conceal outlets in a decorated environment.

BACKGROUND

Modern decorated environments, including tiled backsplashes, walls, and other covered areas, generally include a number of visible outlets disposed therein. Although these visible outlets provide quick access to electrical and/or communications interconnections, they all require some type of interruption in a decorated façade. As can be appreciated, this interruption disturbs the pleasing visual aesthetic associated with a continuously decorated environment.

SUMMARY

A camouflaged protective cover device that has the ability to be customized in order to blend in with the surroundings is disclosed herein. This device can cover an entire wall outlet and not just the perimeter of the outlet receptacle. This protective cover device can be configured to match any surrounding, or decoration, and in some embodiments, may even sit flush with a decorated wall in order to completely conceal or hide unsightly wall outlet(s) from view. For example, the cover device may include one or more surfaces configured to receive at least one decorative element (e.g., matching the decorated wall). The at least one decorative element may include, but is in no way limited to, tile, paint, glass, mirror, wood, wallpaper, texture, etc., and/or combinations thereof.

The cover device can be removed using several methods such as a pull pin, integrated pull tabs, pivoting pull tabs, extended (e.g., non-flush) features, etc., with minimal visible features or disruptive appearance added to the cover device. Further, the cover device may include a number of retaining elements configured to interface with an outlet, receptacle, or interface plate. In some embodiments, these retaining elements and/or other features of the cover device may be made from nonconductive, insulative, and/or dielectric materials. Among other things, these features may prevent the risk of electric shock associated with interfacing with the outlet.

In some embodiments, a camouflaged protective cover device for a wall outlet is provided. The cover device may be designed to hide an unsightly wall outlet from view. Embodiments of the cover device may be designed to be removed easily from the wall outlet to allow for normal functionality of the wall outlet to be resumed. In one embodiment, the cover device may be manufactured from a dielectric element, for example, to protect a user from electric shock.

The cover device may be fitted with a chosen material (e.g., a decorative element, or décor, etc.) that will allow the cover device to camouflage a wall outlet disposed behind the cover device, and hide it from view. The chosen material may be tile, glass, concrete, drywall, wood, paper, paint, and/or other materials used surrounding the wall outlet. The cover device may be composed of a material that is dielectric and also allows any chosen material to be attached to the cover device using the appropriate adhesive, cement, bonding, thinset mortar, or mechanical fastening method to secure the material to the cover device.

The cover device can be made in any size appropriate to cover an outlet. The cover device may be designed to have at least two plugs, or nonconductive protrusions, that use one or more electrical outlet sockets, or receptacles, to retain the cover device against the wall and/or outlet. These plugs can be designed to fit into any one or more of the electrical slots/receptacles on the electrical outlet. The plugs may be manufactured having a particular thickness so that the protrusions will apply enough friction inside the receptacles and/or slots to hold or maintain the cover device in place against the outlet. In addition, one or more ridges, or edges, can be formed in, or added to, the cover device providing a ledge or contact surface to hold the camouflage material in place.

In one embodiment the cover device may be designed to function with a traditional raised and rounded wall outlet perimeter plate. In some cases, the cover device may or may not sit flush against the wall and may need a means for removing the cover device as described herein.

In some embodiments, the cover device may be designed to be used with a flat perimeter, or interface, plate. This flat perimeter plate can be designed to attach to a perimeter of a slightly recessed wall outlet, instead of a standard outlet cover plate. In this embodiment the protective cover device, when installed, may contact the flat perimeter plate attached to the wall outlet and even sit flush with the wall or any décor that has been added to the wall. The flush-mount cover device may be fitted with a means for removal as the user may not otherwise be able to access features (e.g., sides, edges, ridges, etc.) of the cover device to remove the cover device from an installed position in an outlet. The perimeter plate is not limited to the above embodiment and can be used in conjunction with any wall outlet as a means to have the cover device sit closer to the wall than with a standard outlet cover plate installed.

In some embodiments, an electrical outlet tile cover assembly is provided that assists in making electrical outlets less pronounced. The electrical outlet tile cover assembly may comprise a multiple piece assembly including a decorative concealed outlet device and an electrical outlet replacement plate. The replacement plate may be configured as a flat rectangular replacement plate supplied to replace an existing, or standard, electrical outlet cover plate (e.g., used in residential and/or commercial installations, etc.). The decorative concealed outlet device may comprise a plastic, composite, or nonconductive plate that attaches to the electrical outlet by pushing prongs formed in the rear of the plate into the ground side of the electrical outlet. This plate may be designed to accept the same tile that has been or will be applied to a tiled area surrounding the outlet (e.g., a backsplash, etc.). The plate may include a perimeter border creating a smooth finish on the sides of the applied tile. The tile may be glued or otherwise adhered to this plate. In one embodiment, the plate may include a small circular disc push/pull pin that can be inserted into a receiver channel or receptacle after the tile is attached to the plate. The pin may slide into and out of the plate and can allow a user to grip the head of the pin in order to pull the cover plate away from, and/or out of, the electrical outlet exposing the outlet for use.

If a cover device sits in a way when the prongs have been inserted into the wall outlet such that there is no easy finger access for removing the cover device a mechanism for removing the cover device may be attached to, or selectively interconnected with, the cover device. The mechanism for removal may include, but is in no way limited to, a pin, a button, tabs, a rail, four-bar mechanism, string, handles, etc., and/or the like.

In one embodiment a pull pin may be added to the cover device as described herein. This pull pin is not limited to being placed in the center of the cover device and, as such, may be placed in any number of locations on the cover device. This pull pin may be designed so a user can slightly retract the pull pin using a finger nail, tool, or other means. Then, after retracting the pin, the user may grasp a greater portion of the pin and remove the cover device from the wall outlet allowing the outlet to resume normal functionality.

In some embodiments the protective cover device may include one or more grasping features disposed in, or attached to, a portion of the device. This grasping feature may include, but is no way limited to, any of the removal mechanisms described herein. One feature may include a tab, handle, or grasping element, disposed in both the top right and bottom left of the cover device. These tabs, or handles, can allow a user to remove the cover device by applying a pull force to the tabs in a direction away from the outlet. These features and/or mechanisms may be designed to further blend in to the surroundings of the wall and/or the cover device. For instance, the features may be substantially, or at least partially, translucent, transparent, painted, recessed, etc.

In one embodiment, the cover device may be mounted to an outlet via one or more mechanisms configured to articulate the cover device out from an installed position (e.g., revealing a previously concealed outlet). For instance, the cover device may be hingedly attached to the outlet (e.g., via an outlet interface cover plate, or perimeter plate), such that the cover hinges along an edge and, when actuated, pivots away from the outlet. The hinge may include a live hinge (e.g., molded into a portion of the cover device and/or perimeter plate, etc.), a continuous hinge, a four-bar mechanism, a cabinet hinge, and/or combinations thereof. The hinge may be used in flush-mount and/or protruding embodiments. In some cases, the hinge may provide a translation of the cover device out of a flush installed position (e.g., outlet concealed state) along a first axis and then pivot about a second axis to provide access to the outlet (e.g., in an outlet revealed state).

It should be understood that every maximum numerical limitation given throughout this disclosure is deemed to include each and every lower numerical limitation as an alternative, as if such lower numerical limitations were expressly written herein. Every minimum numerical limitation given throughout this disclosure is deemed to include each and every higher numerical limitation as an alternative, as if such higher numerical limitations were expressly written herein. Every numerical range given throughout this disclosure is deemed to include each and every narrower numerical range that falls within such broader numerical range, as if such narrower numerical ranges were all expressly written herein.

The preceding is a simplified summary of the disclosure to provide an understanding of some aspects of the disclosure. This summary is neither an extensive nor exhaustive overview of the disclosure and its various aspects, embodiments, and configurations. It is intended neither to identify key or critical elements of the disclosure nor to delineate the scope of the disclosure but to present selected concepts of the disclosure in a simplified form as an introduction to the more detailed description presented below. As will be appreciated, other aspects, embodiments, and configurations of the disclosure are possible utilizing, alone or in combination, one or more of the features set forth above or described in detail below.

BRIEF DESCRIPTION OF THE DRAWINGS

The accompanying drawings are incorporated into and form a part of the specification to illustrate several examples of the present disclosure. These drawings, together with the description, explain the principles of the disclosure. The drawings simply illustrate preferred and alternative examples of how the disclosure can be made and used and are not to be construed as limiting the disclosure to only the illustrated and described examples. Further features and advantages will become apparent from the following, more detailed, description of the various aspects, embodiments, and configurations of the disclosure, as illustrated by the drawings referenced below.

DETAILED DESCRIPTION

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

Embodiments of the present disclosure will be described in connection with a decorative concealed outlet device. The decorative concealed outlet device may be configured to selectively engage with and/or cover an outlet, such as an electrical and/or communications outlet, an outlet cover plate, a switch (e.g., a light switch, outlet switch, etc.), and/or a switch cover plate. Although embodiments described herein may refer to an outlet, or an outlet cover, it should be appreciated that a switch, or a switch cover, may be similarly concealed and/or covered by the decorative concealed outlet device. The decorative concealed outlet device may include one or more surfaces configured to receive a decorative element, or elements, that match a decorated area surrounding the outlet. For instance, in a tiled environment having a number of outlets, the decorative concealed outlet device may include a portion of tile (e.g., adhered thereto) that matches, or substantially matches, the tile surrounding the outlets. When the decorative concealed outlet device is engaged with one or more of the outlets, the body of the decorative concealed outlet device and attached matched decorative elements may cover one or more of the outlets. As the decorative elements attached to the decorative concealed outlet device match the surrounding decorative elements of the outlets, the one or more outlets may be concealed, or hidden, from view (e.g., disposed behind the decorative concealed outlet device).

Figure 1A:
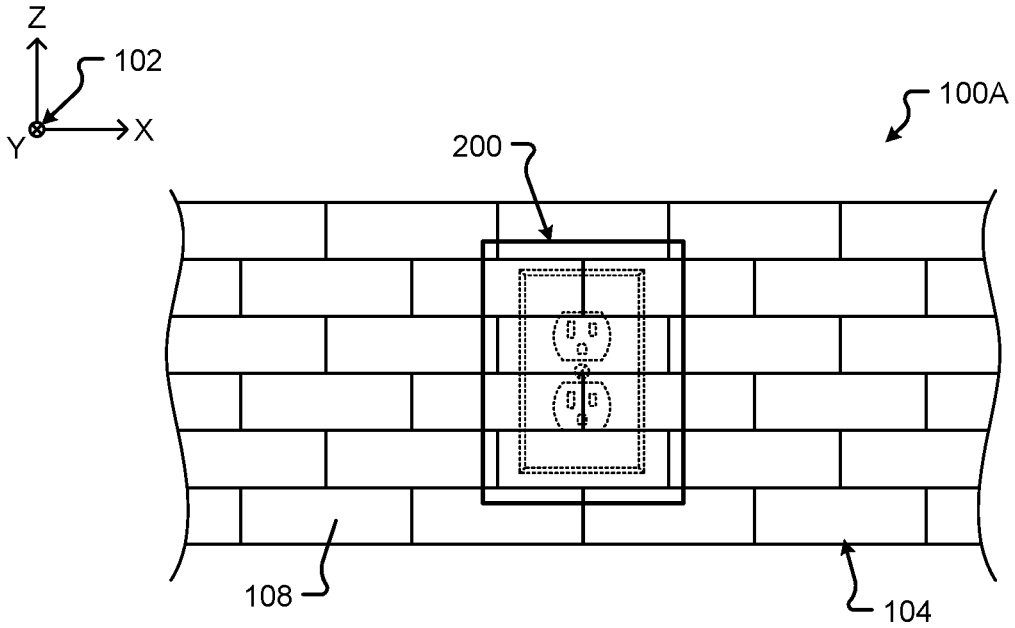
FIG. 1A shows a decorated and concealed outlet environment in accordance with embodiments of the present disclosure.

FIG. 1A shows a decorated and concealed outlet environment 100A in accordance with embodiments of the present disclosure. As shown in FIG. 1A, the concealed outlet environment 100A may include a decorated area 104 comprising one or more decorative elements 108 surrounding a concealed outlet. The decorated area 104 may include, but is no way limited to, a physical surface (e.g., a wall, divider, floor, ceiling, etc.) that is decorated with decorative elements 108 such as tile, stone, glass, metal, wood, wallpaper, textiles, natural elements, paint, textures, etc., and/or the like. One or more outlets may be concealed by a decorative concealed outlet device 200, as described herein. Portions of the decorative concealed outlet device 200 may engage with the outlet, an interface plate for the outlet, the wall, and/or combinations thereof.

Figure 1B:
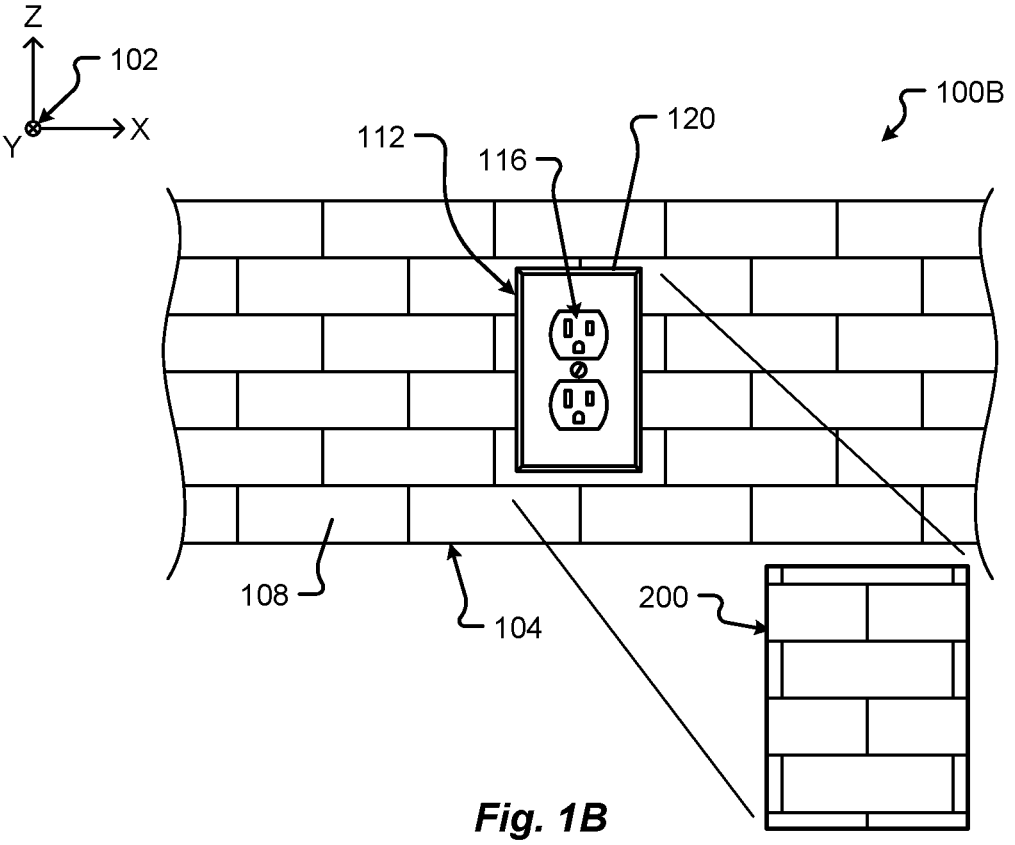
FIG. 1B shows the outlet environment of FIG. 1A with a decorative concealed outlet device removed from concealing an outlet.

In some embodiments, reference may be made to one or more positions, locations, arrangements, and/or orientations of features relative to one another and/or to a coordinate system 102. As shown in FIGS. 1A-1B, the coordinate system 102 includes an X-axis (e.g., running horizontally across the page), a Z-axis (e.g., running vertically across the page), and a Y-axis (e.g., running into and/or out of the page). In some embodiments, the X-axis may be used to define a width of one or more components of the decorative concealed outlet device 200, the Y-axis may be used to define a depth or thickness of one or more components of the decorative concealed outlet device 200, and the Z-axis may be used to define a height of one or more components of the decorative concealed outlet device 200.

FIG. 1B shows a revealed outlet environment 100B with the decorative concealed outlet device 200 of the outlet environment of FIG. 1A removed from concealing an outlet 112. The decorative concealed outlet device 200 in FIG. 1B has been moved from an engaged position with the outlet 112 to a disengaged position from the outlet 112. In one embodiment, the decorative concealed outlet device 200 may be disengaged from the outlet 112 by moving the decorative concealed outlet device 200 in the Y-axis in a direction away from the outlet 112, wall, and/or the decorated area 104.

Although shown as an electrical outlet, the outlet 112 may include any power, electrical, and/or communications outlet known in the art. For instance, the electrical outlet described herein may correspond to any foreign or domestic electrical and/or communications outlet. Examples of electrical outlets may include, but are no way limited to, alternating current (AC) outlets, types A-L outlets, direct current (DC) connection outlets, etc., Examples of communications outlets and ports may include, but are in no way limited to, registered jack (RJ) ports, RJ-11 ports, RJ-14 ports, RJ-21 ports, RJ-25 ports, RJ-45 ports, RJ-45S ports, RJ-48 ports, RJ-61 ports, audio visual ports and outlets, high-definition multimedia interface (HDMI) ports, computer interface outlets, and/or combinations thereof. In one embodiment, the outlet 112 may include a junction box, a switch, a button, a slider, an outlet receptacle, and/or some other feature having one or more ports, slots, receptacles, switching elements, actuating features, and/or receiving features. As shown in FIG. 1B, the outlet 112 may include one or more outlet ports 116 and/or an outlet cover plate 120. The outlet cover plate 120 may be configured as a standard outlet cover plate attached to the outlet 112 (e.g., via one or more screws, clips, etc.) and extending from a surface of the wall and/or decorated area 104.

FIGS. 2A-2E show various views of the decorative concealed outlet device 200 in accordance with embodiments of the present disclosure. The decorative concealed outlet device 200 may include a decorative cover frame 204 and a matched decorative element 206 attached thereto. The decorative concealed outlet device 200 may include a substantially planar surface having a decorative element mount surface 208 configured to receive a matched decorative element 206. The decorative element mount surface 208 may be a rough or irregular surface, and/or a grooved, scored, textured, and/or an otherwise interrupted surface feature 209 (shown in FIG. 2B). It is an aspect of the present disclosure that this interrupted surface feature 209 may be configured to receive adhesive and provide enhanced grip between the matched decorative element 206 and the decorative element mount surface 208 beyond that of a merely flat smooth surface. Among other things, the interrupted surface feature 209 may provide a greater adhesive contact surface area for an adhesive layer 210, or adhesive material. The adhesive layer 210 may include, but is in no way limited to, construction adhesive, thinset mortar, glue, caulk, grout, tape, hook-and-loop fasteners, mechanical fasteners, polymer adhesives, compounds, etc., and/or combinations thereof.

In one embodiment, the adhesive layer 210 may be applied to the decorative element mount surface 208 of the decorative cover frame 204 and the matched decorative element 206 may be attached thereto. The matched decorative element 206 may be one or more decorative elements (e.g., tiles, wood pieces, etc., and/or combinations/sections thereof). Where a number of pieces make up the matched decorative element 206, each piece may be attached to the decorative cover frame 204 separately or the matched decorative element 206 may be preassembled prior to attaching combined pieces together to the decorative cover frame 204.

The decorative concealed outlet device 200 may include a lip or ridge 212 formed along one or more peripheral edges of the decorative cover frame 204. As shown in the exploded perspective view of FIG. 2B, for example, the peripheral ridges 212 are formed along an edge of the frame lower section 214, an edge of the frame top section 215, and along edges of each side of the decorative cover frame 204 disposed between the frame lower section 214 and the frame top section 215. In some embodiments, the peripheral ridges 212 may be formed as part of the decorative cover frame 204 (e.g., as one or more protrusions extending from the decorative element mount surface 208 of the decorative cover frame 204). In one embodiment, the peripheral ridge 212 may include one or more snap lines, or removal features, to selectively remove a peripheral ridge 212 from a particular side, or sides, of the decorative cover frame 204. These snap line removal features are described in greater detail in conjunction with FIGS. 14A-14E.

Figure 2A:
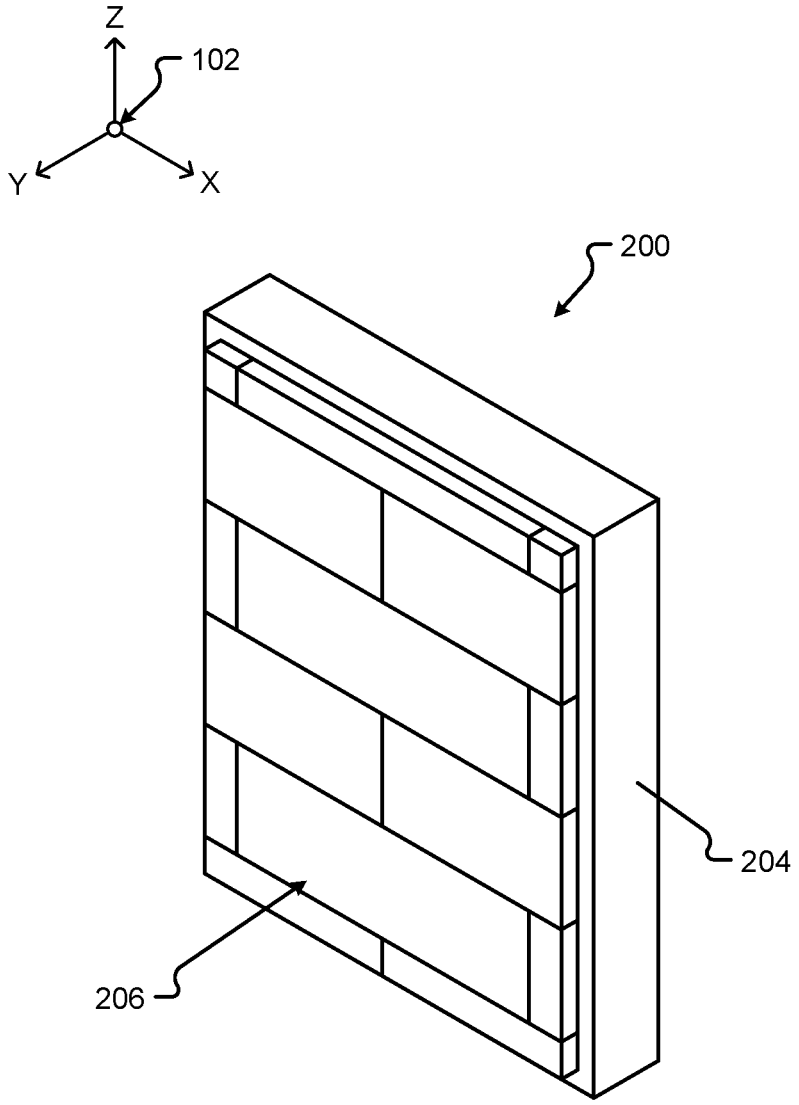
FIG. 2A shows a perspective view of the decorative concealed outlet device in accordance with embodiments of the present disclosure.
Figure 2B:
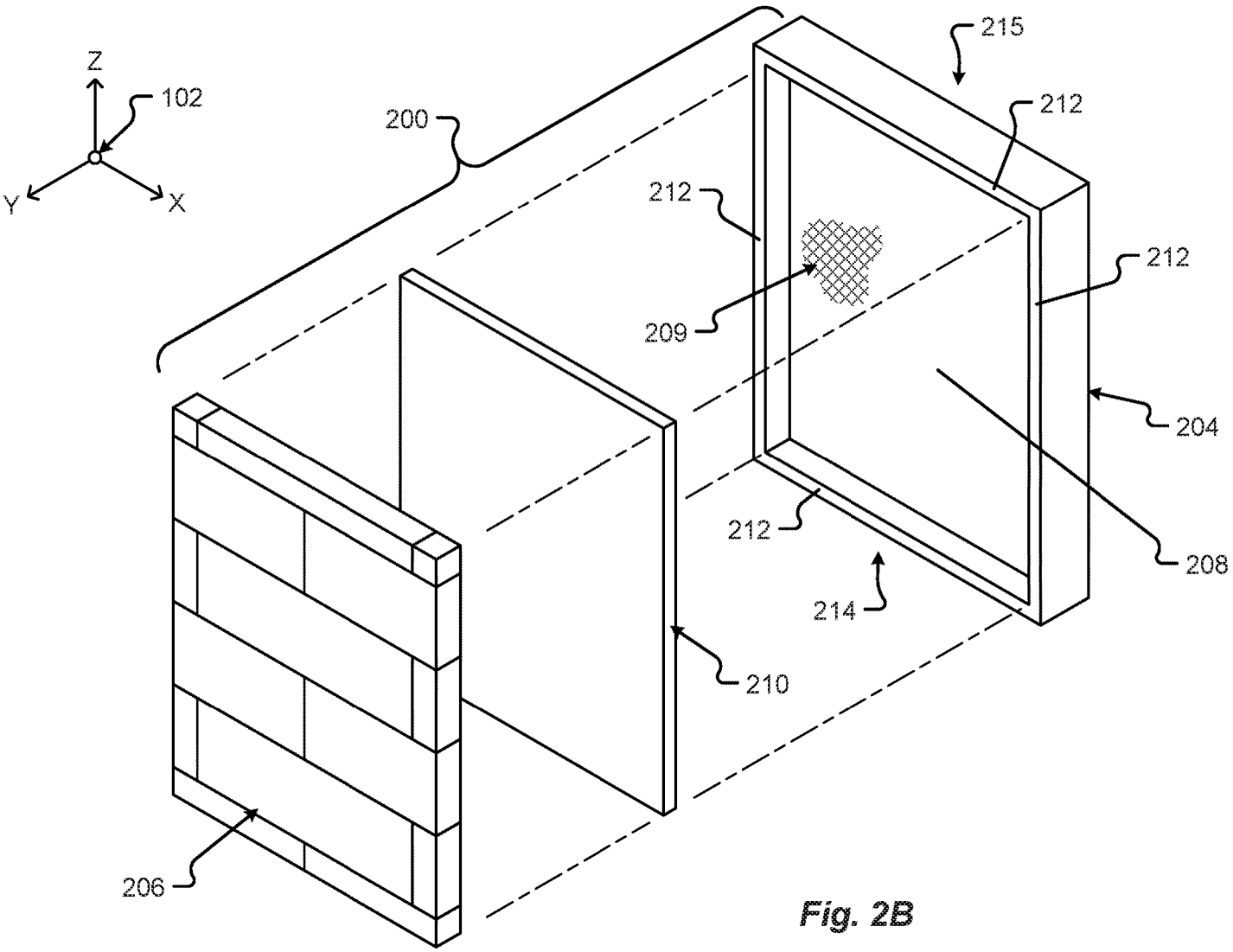
FIG. 2B shows an exploded perspective view of the decorative concealed outlet device of FIG. 2A.
Figure 2C:
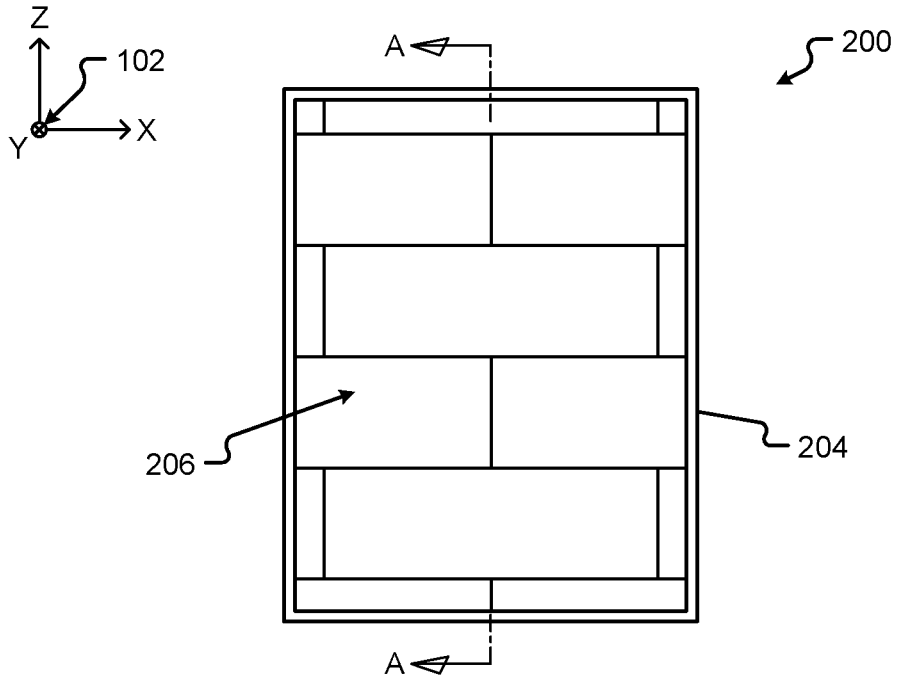
FIG. 2C shows an elevation view of the decorative concealed outlet device of FIG. 2A.

In the event that a peripheral ridge 212 is formed on all sides, or edges, of the decorative cover frame 204, a decorative element receiving area may be formed therebetween. For instance, FIG. 2B shows a recessed, or depressed, area in between the peripheral ridges 212 including the decorative element mount surface 208 for receiving at least a portion of the matched decorative element 206 and/or the adhesive layer 210. The peripheral ridges 212 may form a border for the matched decorative element 206 attached to the decorative cover frame 204 and, as such, may be sized to a grout width a decorative separation distance, and/or a predetermined border width.

Figure 2D:
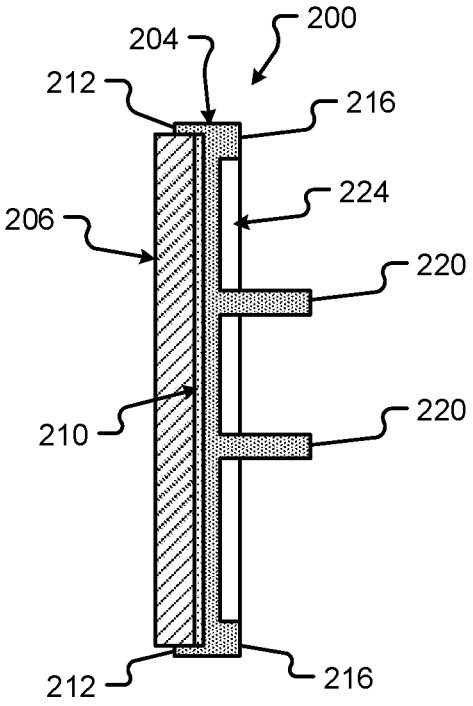
FIG. 2D shows a section elevation view of the decorative concealed outlet device taken through line A-A of FIG. 2C.
Figure 2E:
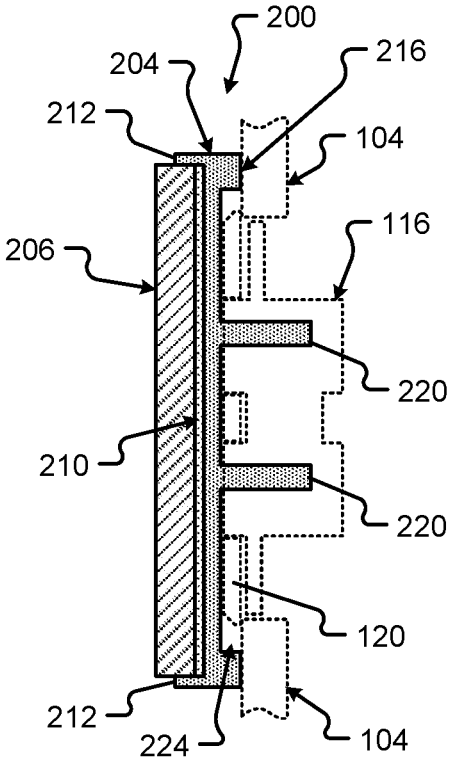
FIG. 2E shows a section elevation view of the decorative concealed outlet device taken through line A-A of FIG. 2C engaged with an outlet.

As shown in FIGS. 2D-2E, the peripheral ridges 212 may extend along a thickness of the matched decorative element 206 attached to the decorative cover frame 204. Although shown as extending along a partial thickness of the matched decorative element 206, it should be appreciated that the peripheral ridges 212 may extend the same distance as the thickness of the matched decorative element 206 such that the front-facing surface (e.g., the surface of the peripheral ridge 212 disposed opposite to, and facing away from, the rear frame contact surface 216, etc.) may be flush, or substantially flush with the front visible surface of the matched decorative element 206. In one embodiment, the front-facing surface of the peripheral ridge 212 may extend beyond the front visible surface of the matched decorative element 206, such that the front visible surface of the matched decorative element 206 sits under-flush to the front-facing surface of the peripheral ridge 212.

The decorative concealed outlet device 200 may optionally include a rear frame recess 224 disposed at a rear of the decorative cover frame 204. The rear frame recess 224 may form a pocket to receive one or more portions of the outlet 112. As shown in the section elevation views of FIGS. 2D-2E, the rear frame recess 224 may extend a depth into the body of the decorative cover frame 204 from the rear frame contact surface 216 of the decorative cover frame 204. In some embodiments, the rear frame recess 224 may be sized to receive and cover a standard outlet cover plate 120 as shown in FIG. 2E. In this example, the outlet 112 and the outlet cover plate 120 may be completely covered by the decorative concealed outlet device 200. The rear frame contact surface 216 may contact a portion of the wall and/or the decorated area 104 surrounding the outlet 112.

As provided herein, the decorative concealed outlet device 200 may be engaged with an outlet, or outlet cover, via one or more prongs or frame retaining protrusions 220. The frame retaining protrusions 220 may extend from the rear of the decorative cover frame 204 in a direction away from both the decorative element mount surface 208 and the rear frame contact surface 216 of the decorative cover frame 204. The frame retaining protrusions 220 may be formed from a material of the decorative cover frame 204 and/or attached to the decorative cover frame 204 forming a single functional unit. In one embodiment, the frame retaining protrusions 220 may be molded into, or as part of, the decorative cover frame 204. The frame retaining protrusions 220 may be sized to engage with one or more outlet ports 116 of an outlet 112, a mating feature disposed in an outlet cover plate 120, and/or other features of the outlet 112. In one embodiment, the frame retaining protrusions 220 may frictionally fit with a ground, positive, and/or neutral receptacle of an outlet 112. The frame retaining protrusions 220, without limitation, may be as described in conjunction with any one or more of the frame protruding and/or retaining features described in conjunction with FIGS. 2D-8B.

The decorative cover frame 204 may be made from a substantially, or at least partially, translucent, transparent, and/or clear material. Among other things, a translucent material may allow the color and/or appearance of the adhesive layer 210 and/or the matched decorative element 206 to show through the decorative cover frame 204. This visible color may further provide a camouflaging effect to blend the decorative concealed outlet device 200 with a surrounding decorated area 104. Additionally or alternatively, the decorative cover frame 204, the frame retaining protrusions 220, and/or other components of the decorative concealed outlet device 200 may be made from a nonconductive, insulative, and/or dielectric material. Examples of nonconductive materials may include plastic, rubber, fiberglass, paper, linen, composites, etc., and/or combinations thereof. Among other things, this nonconductive material may allow the frame retaining protrusions 220 to be inserted into, and/or removed from, electrical contact receptacles of an outlet 112 without fear of electric shock, or conducting electricity through the decorative concealed outlet device 200 to a user.

It is an aspect of the present disclosure that the decorative concealed outlet device 200 may be made from any decorative cover frame 204, 404, 504, 604, 704, 804, 1004, 1204, 1304, 1404, etc., described herein and/or in conjunction with FIGS. 3A-6B, 7A-7B, 8A-8B, 9A-10D, and 12-14E. In any event, the decorative concealed outlet device 200 may include any decorative cover frame coupled with a matched decorative element 206 as described herein.

Figure 3B:
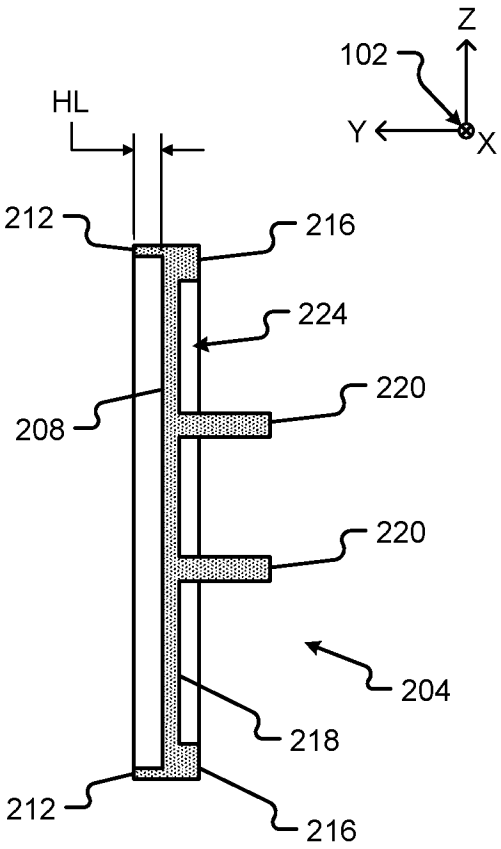
FIG. 3B shows a section elevation view of the decorative cover frame of FIG. 3A taken through line B-B.
Figure 3A:
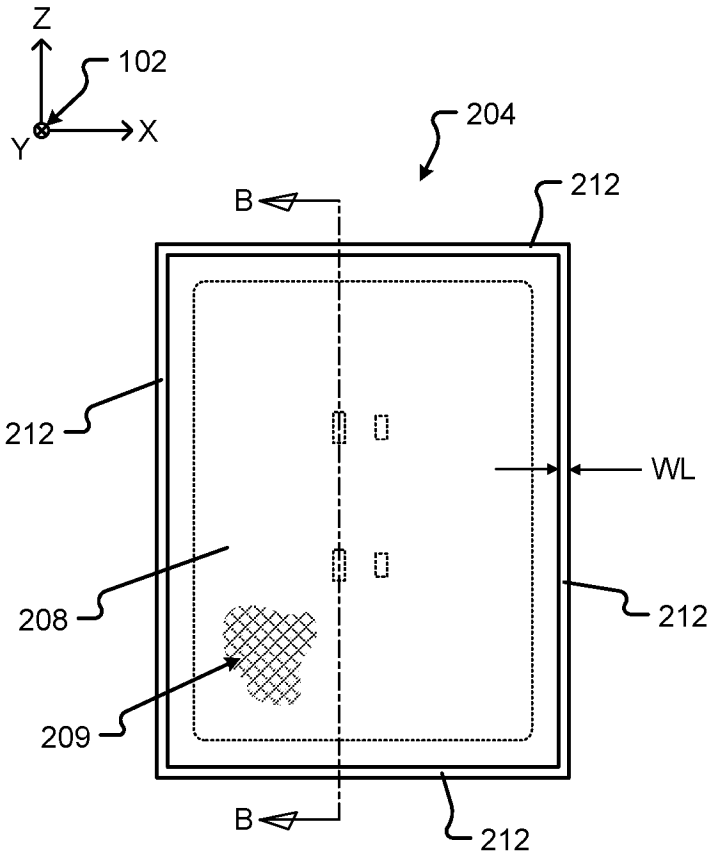
FIG. 3A shows an elevation view of a decorative cover frame of the decorative concealed outlet device in accordance with embodiments of the present disclosure.

FIGS. 3A-3B show various views of the decorative cover frame 204 of the decorative concealed outlet device 200 in accordance with embodiments of the present disclosure. As shown in FIGS. 3A-3B, the peripheral ridges 212 of the decorative cover frame 204 are formed along the top, bottom, and side edges of the decorative cover frame 204. In some embodiments, each peripheral ridge 212 may include a ridge width, WL, and a ridge height, HL. The ridge width, WL, may define a border thickness for a matched decorative element 206 attached to the decorative element mount surface 208. For example, the ridge width, WL, may extend beyond the matched decorative element 206 attached to the decorative element mount surface 208 in the X-axis and/or the Z-axis directions. The ridge height, HL, may define an amount of coverage of the peripheral ridge 212 along a portion of the matched decorative element 206 in the Y-axis direction.

As described above, the frame retaining protrusions 220 may extend a length from a rear surface of the decorative cover frame 204. The length of the frame retaining protrusions 220 may be sized to interface with a receiving receptacle of an outlet 112. For instance, the length of the frame retaining protrusions 220 may fit within a depth of a standard outlet port 116 associated with an outlet 112. Although shown as protrusions matching a grounded and ungrounded contact of a standard United States 120V dual electrical outlet 112, it should be appreciated that the frame retaining protrusions 220 described herein may be associated with any one or more electrical outlet receptacles of an outlet 112 (e.g., grounded contact slot, ungrounded contact slot, grounded contact opening, communications port, etc.), multi-receptacle outlets (foreign or domestic), 220V electrical outlets, and/or one or more outlets 112 arranged side-by-side to one another (e.g., 2-gang, 3-gang, 4-gang, etc.). For instance, the frame retaining protrusions 220 may be shaped, sized, and/or arranged as described in conjunction with FIGS. 5A-5B, 6A-6B, 7A-7B, etc. Additionally or alternatively, the frame retaining protrusions 220 may be substantially rectangular in cross-section, substantially circular in cross-section, and/or polygonal in cross-section. In some embodiments, the frame retaining protrusions 220 may taper from a first cross-sectional area at the rear frame contact surface 216 to a smaller second cross-sectional area at a distance from the rear frame contact surface 216. This taper may match a draft angle of a mold used to manufacture the decorative cover frame 204.

The decorative cover frame 204 is shown in FIG. 3B including a rear frame recess 224 extending a depth (e.g., along the Y-axis direction) from the rear frame contact surface 216 into the body of the decorative cover frame 204 to a recessed rear surface 218. It is an aspect of the present disclosure that this rear frame recess 224 may be sized to envelop, or at least partially enclose, a standard outlet cover plate 120 of an outlet 112. Embodiments of the decorative cover frame 204 described herein are not limited to including a rear frame recess 224, and may appear as illustrated and described in conjunction with FIGS. 4A-5B, 6A-6B, 7A-7B, etc.

Figure 4B:
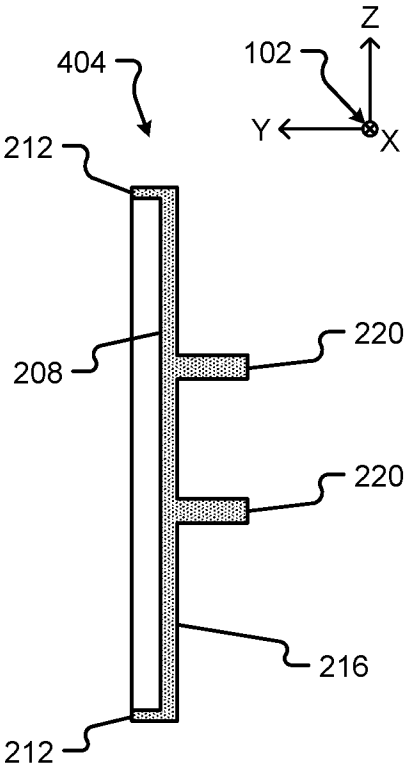
FIG. 4B shows a section elevation view of the decorative cover frame of FIG. 4A taken through line C-C.
Figure 4A:
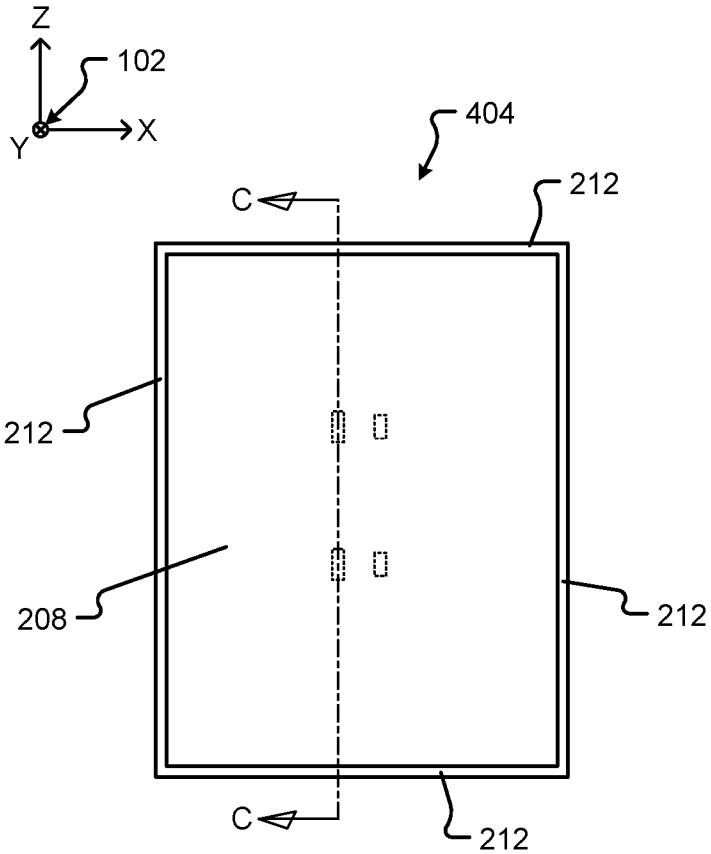
FIG. 4A shows an elevation view of a decorative cover frame of the decorative concealed outlet device in accordance with embodiments of the present disclosure.

FIGS. 4A-4B show various views of a decorative cover frame 404 of the decorative concealed outlet device 200 in accordance with embodiments of the present disclosure. As can be appreciated, the decorative cover frame 404 of FIGS. 4A-4B may be fitted with a matched decorative element 206 and/or an adhesive element or adhesive layer 210 to form a decorative concealed outlet device 200. The features of the decorative cover frame 404 may be similar, if not identical, to the features described in conjunction with the decorative cover frame 204 of FIGS. 3A-3B, or vice versa. In some embodiments, the decorative cover frame 404 may correspond to the decorative cover frame 204 described in conjunction with FIGS. 3A-3B without the rear frame recess 224 feature. In this instance, the decorative cover frame 404 and/or decorative concealed outlet device 200 including the decorative cover frame 404, may be engaged with an outlet 112 via the frame retaining protrusions 220 extending from the rear frame contact surface 216. The decorative cover frame 404 may contact the outlet 112, the outlet cover plate 120, a wall, and/or the decorated area 104 at the rear frame contact surface 216.

The decorative cover frame 404 without the rear frame recess 224 (e.g., as described in conjunction with the decorative cover frame 204 of FIGS. 3A-3B, etc.) may provide a thinner, shorter, or slimmer decorative concealed outlet device 200. For example, the overall thickness of the decorative cover frame 404 (e.g., along the Y-axis) may be less than the overall thickness of the decorative cover frame 204 including the rear frame recess 224. A decorative concealed outlet device 200 including a thin frame (such as the decorative cover frame 404) may be used in flush-mount applications (e.g., where the visible surface of the matched decorative element 206 lies flush, or substantially flush, with the visible surface of the decorated area 104, etc.) and/or over-flush-mount applications (e.g., where the visible surface of the matched decorative element 206 is offset from the visible surface of the decorated area 104, etc.).

Figure 5B:
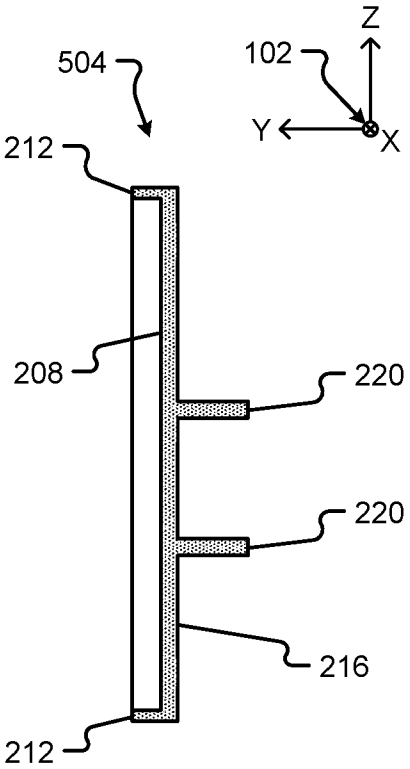
FIG. 5B shows a section elevation view of the decorative cover frame of FIG. 5A taken through line D-D.
Figure 5A:
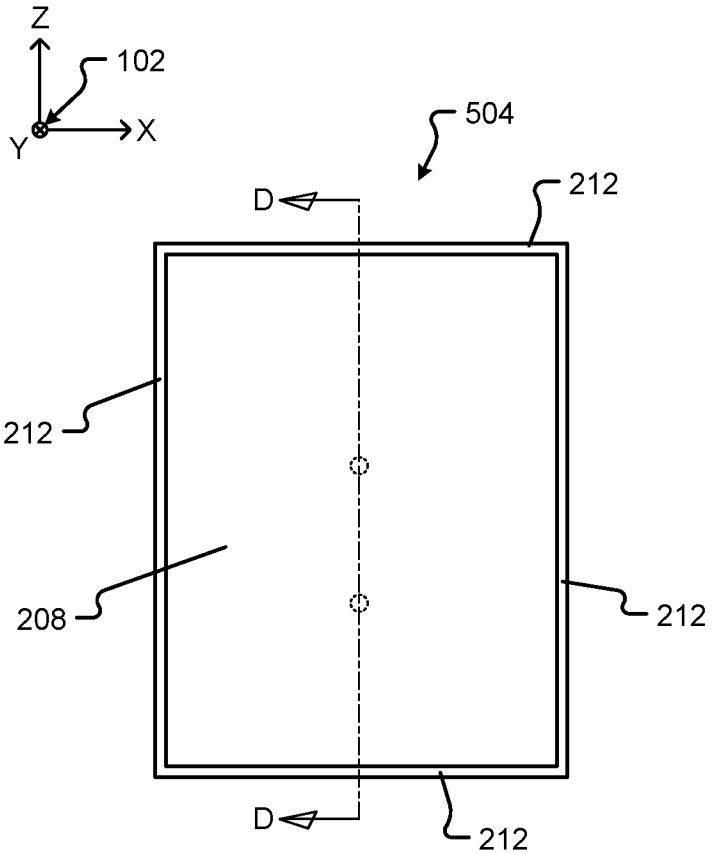
FIG. 5A shows an elevation view of a decorative cover frame of the decorative concealed outlet device in accordance with embodiments of the present disclosure.

FIG. 5A-5B show various views of a decorative cover frame 504 of the decorative concealed outlet device 200 in accordance with embodiments of the present disclosure. As can be appreciated, the decorative cover frame 504 of FIGS. 5A-5B may be fitted with a matched decorative element 206 and/or an adhesive element or adhesive layer 210 to form a decorative concealed outlet device 200. The features of the decorative cover frame 504 may be similar, if not identical, to the features described in conjunction with the decorative cover frames 204, 404 of FIGS. 3A-3B and FIGS. 4A-4B, or vice versa. In some embodiments, the decorative cover frame 504 may correspond to the decorative cover frame 404 described in conjunction with FIGS. 4A-4B with different frame retaining protrusions 220. The frame retaining protrusions 220 shown in FIGS. 5A-5B may be configured (e.g., sized and/or arranged) to interconnect with a ground opening in an outlet 112. In this instance, the decorative cover frame 504 and/or decorative concealed outlet device 200 including the decorative cover frame 504, may be engaged with an outlet 112 via the frame retaining protrusions 220 extending from the rear frame contact surface 216 (e.g., into the ground openings, etc.). The decorative cover frame 504 may contact the outlet 112, the outlet cover plate 120, a wall, and/or the decorated area 104 at the rear frame contact surface 216.

Figure 5C:
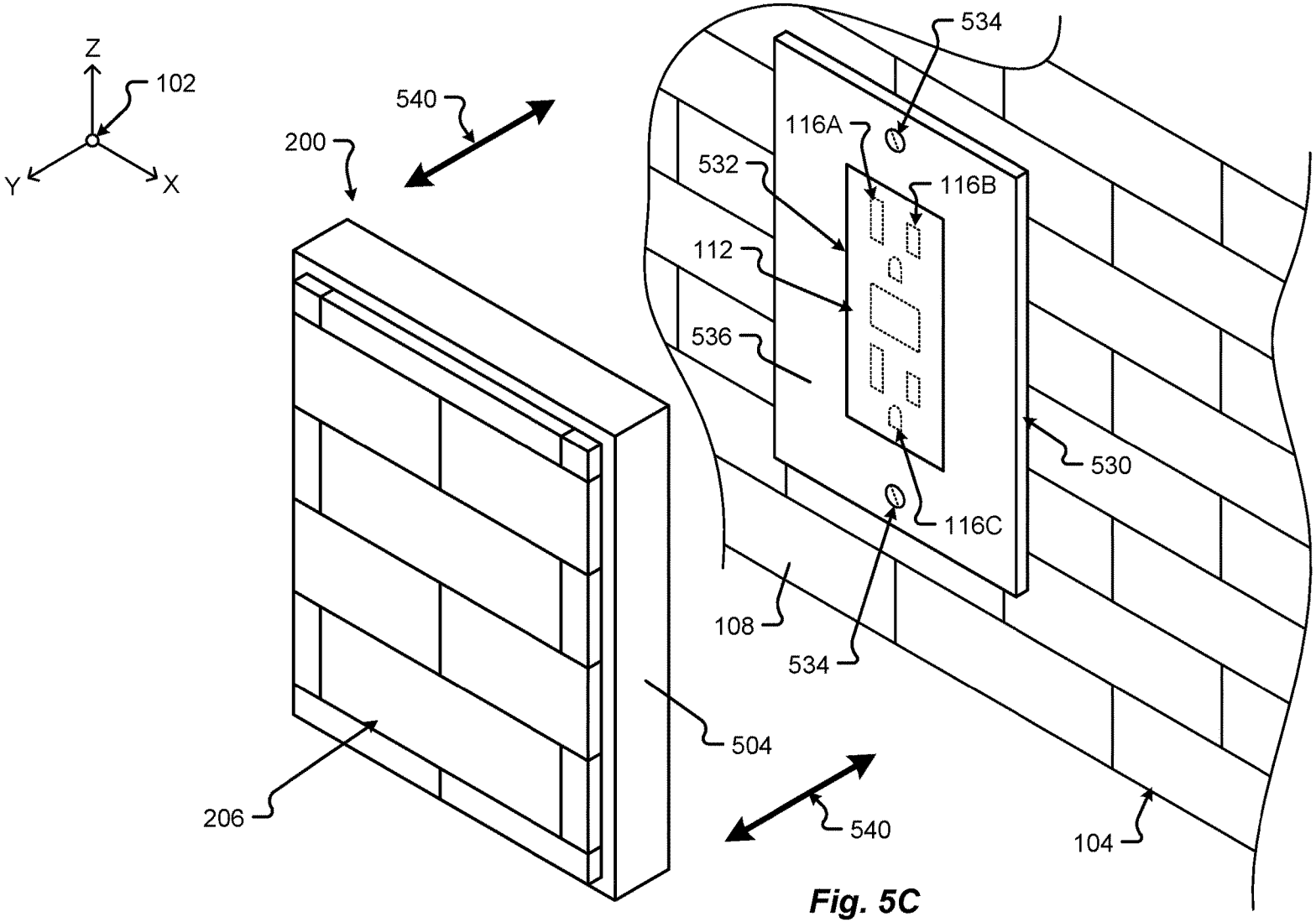
FIG. 5C shows a perspective view of a decorative concealed outlet device and outlet backplate in accordance with embodiments of the present disclosure.

The decorative cover frame 504 may provide a thin decorative concealed outlet device 200 as shown in FIG. 5C. For example, the overall thickness of the decorative cover frame 504 (e.g., along the Y-axis) may be less than the overall thickness of the decorative cover frame 204 (e.g., including the rear frame recess 224). A decorative concealed outlet device 200 including the thin decorative cover frame 504 may be used in flush-mount applications (e.g., where the visible surface of the matched decorative element 206 lies flush, or substantially flush, with the visible surface of the decorated area 104, etc.) and/or over-flush-mount applications (e.g., where the visible surface of the matched decorative element 206 is offset from the visible surface of the decorated area 104, etc.).

FIG. 5C shows a perspective view of a decorative concealed outlet device 200 including the decorative cover frame 504 and an outlet backplate 530 in accordance with embodiments of the present disclosure. The decorative concealed outlet device 200 may be selectively engaged and disengaged from the outlet 112 along the device engagement/disengagement direction 540 shown in FIG. 5C.

It is an aspect of the present disclosure that the decorative concealed outlet device 200 may be used in conjunction with a special outlet backplate 530. The backplate 530 may be attached to standard or existing mount points of an outlet 112 via one or more backplate mount features 534. The standard mount points may correspond to threaded holes and the backplate mount features 534 may correspond to screws. In one embodiment, the backplate 530 may have a thickness (e.g., in the Y-axis direction) that is thinner than a standard outlet cover plate 120. Among other things, this thin backplate 530 may provide a closer engaged or mount state for an installed decorative concealed outlet device 200 having the decorative cover frame 504 than if the decorative concealed outlet device 200 was engaged with an outlet 112 having a standard outlet cover plate 120.

In some embodiments, the backplate 530 may be configured as a substantially planar body having an outlet aperture 532 passing therethrough. The backplate 530 may be configured to receive a portion of the outlet 112 through the backplate interface surface 536. The backplate outlet aperture 532 may match a shape of an outlet 112, outlet ports 116, and/or combinations thereof. In one embodiment, the backplate 530 may include a backplate interface surface 536. When a decorative concealed outlet device 200 is engaged with the outlet 112, the rear frame contact surface 216 of the decorative concealed outlet device 200 may contact the backplate interface surface 536. Similar to the material of the decorative cover frame 204, 404, 504, the material of the backplate 530 may be made from a translucent, transparent, and/or clear material. Additionally or alternatively, the material of the backplate 530 may be nonconductive, insulative, and/or dielectric.

Embodiments of the decorative concealed outlet device 200 described herein may engage with one or more outlet ports 116 of an outlet 112. For instance, the frame retaining protrusions 220 of the decorative cover frame 204, 404, 504 may be matched to fit in a first outlet port 116A, a second outlet port 116B, and/or a third outlet port 116C of an outlet 112. In any event, the frame retaining protrusions 220 may be sized to frictionally fit with one or more of the outlet ports 116.

In some embodiments, the decorative concealed outlet device 200 may be configured to interface and/or interconnect with a custom cover plate. For example, a decorative cover frame may include a number of features that are designed to engage with corresponding, or mating, features disposed in a custom cover plate for an outlet 112. The engaging features of the decorative cover frame designed to interface with a custom cover plate may be similar to the frame retaining protrusions 220 as previously described and, as such, may extend or protrude from a body of the decorative cover frame in a direction away from the decorative element mount surface 208 and the rear frame contact surface 216. Examples of these custom decorative cover frames and plates are described in conjunction with FIGS. 6A-8C. It is an aspect of the present disclosure that each of the cover plates 630, 730, 830 may be mounted to an outlet 112 in a similar, if not identical, manner as the backplate 530 is mounted to the outlet 112 described in conjunction with FIG. 5C. For instance, each custom cover plate 630, 730, 830 may include one or more backplate mount features 534 that allow the custom cover plate 630, 730, 830 to be physically affixed and/or attached to an outlet 112. The custom cover plates 630, 730, 830, and/or variations thereof, may be used in covering any outlet described herein including, but not limited to, an electrical outlet, a communications outlet, a switch, a switching element, and/or combinations thereof. In some embodiments, the custom cover plates 630, 730, 830 may be used to interface with corresponding, or mating, frames 604, 704, 804. In one embodiment, these mating frames 604, 704, 804 may be configured to only interface with the custom cover plates 630, 730, 830 and not interface with a receptacle, port, or receiving feature of a covered or concealed outlet 112. By way of example, the custom cover plates 630, 730, 830 may emborder a switch or switching element that does not include a receiving feature (e.g., slot, receptacle, opening, hole, etc.). In this example, the decorative concealed outlet device 200 can employ a decorative cover frame 604, 704, 804 that interfaces with a corresponding custom cover plate 630, 730, 830, etc.

Figure 6B:
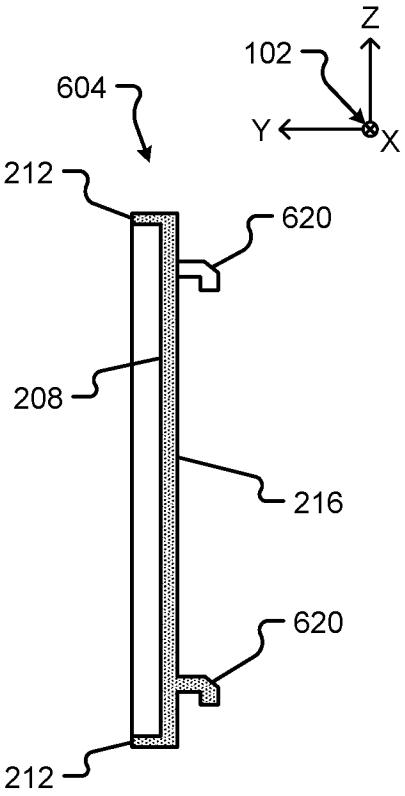
FIG. 6B shows a section elevation view of the decorative cover frame of FIG. 6A taken through line E-E.
Figure 6A:
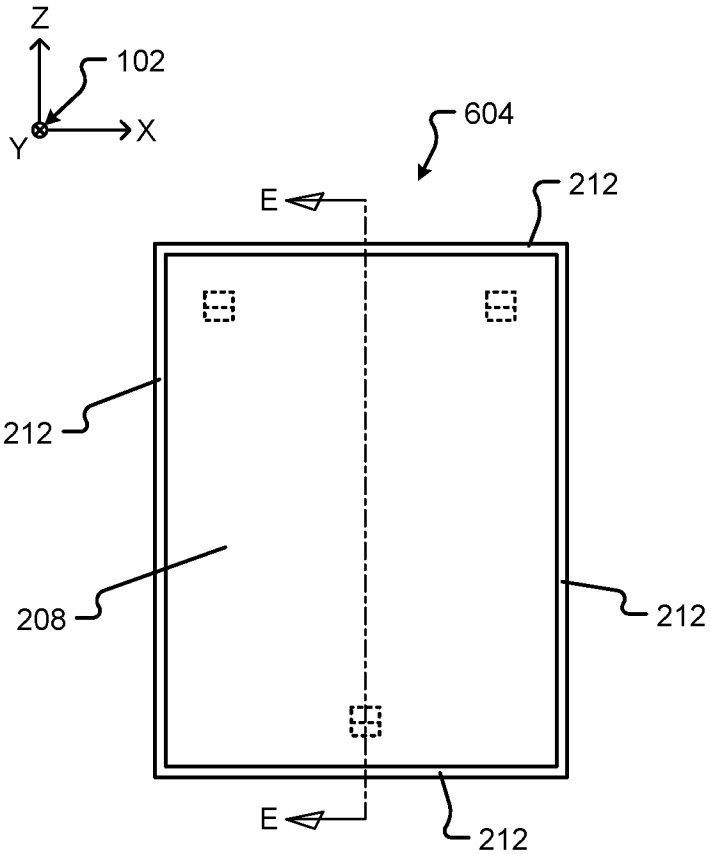
FIG. 6A shows an elevation view of a decorative cover frame of the decorative concealed outlet device in accordance with embodiments of the present disclosure.

FIGS. 6A-6B show various views of a decorative cover frame 604 of the decorative concealed outlet device 200 in accordance with embodiments of the present disclosure. As can be appreciated, the decorative cover frame 604 of FIGS. 6A-6B may be fitted with a matched decorative element 206 and/or an adhesive element or adhesive layer 210 to form a decorative concealed outlet device 200. The features of the decorative cover frame 604 may be similar, if not identical, to the features described in conjunction with the decorative cover frames 204, 404, 504 of FIGS. 3A-3B, 4A-4B, and 5A-5C, or vice versa. The decorative cover frame 604 may include an optional rear frame recess 224 as described in conjunction with FIGS. 3A-3B. For example, where the decorative cover frame 604 is used to cover a switch, or switching element, style of outlet, the rear frame recess 224 may receive a portion of the switch or switching element. In some embodiments, the rear frame recess 224 may allow the decorative cover frame 604 to cover the switch or switching element while providing clearance between the decorative cover frame 604 and the switch or switching element of the outlet disposed at least partially inside the rear frame recess 224. In any event, the decorative cover frame 604 and/or decorative concealed outlet device 200 including the decorative cover frame 604, may be engaged with a custom hook interface backplate 630 (described in conjunction with FIG. 6C) for an outlet 112 via one or more frame retaining hooks 620. The frame retaining hooks 620 may extend from the rear frame contact surface 216. The decorative cover frame 604 may contact the custom hook interface backplate 630 for the outlet, the outlet 112, a wall, and/or the decorated area 104 at the rear frame contact surface 216.

The frame retaining hooks 620 of the decorative cover frame 604 may include a first portion of material extending a first defined distance from the rear frame contact surface 216 along the Y-axis direction, away from the decorative element mount surface 208 and the rear frame contact surface 216. In addition, the frame retaining hooks 620 may include a second portion of material extending a second defined distance from the first portion of material in a direction along, or substantially along, the Z-axis direction. This second portion of material joined with the first portion of material may define a hook feature to maintain a position of the decorative concealed outlet device 200 including the decorative cover frame 604 relative to an outlet 112 and/or a hook interface backplate 630. For instance, the frame retaining hooks 620 may prevent movement of the decorative cover frame 604 along the X-axis directions, Y-axis directions, and at least one direction of the Z-axis shown in conjunction with the coordinate system 102.

Figure 6C:
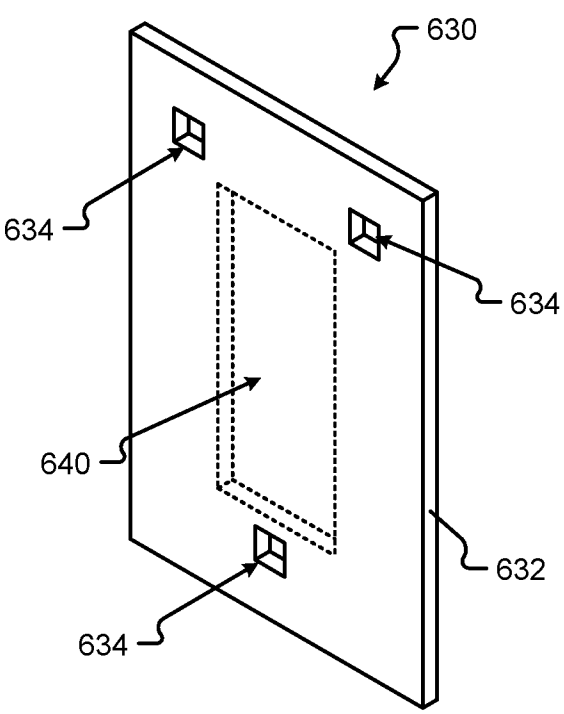
FIG. 6C shows a perspective view of a mating outlet cover plate for the decorative cover frame shown in FIGS. 6A and 6B.

FIG. 6C shows a perspective view of the mating outlet cover plate, or hook interface backplate 630, for the decorative cover frame 604 shown in FIGS. 6A and 6B. In particular, the hook interface backplate 630 may include a backplate body 632 including a number of hook retaining features 634. In some embodiments, the hook retaining features 634 may be configured as holes, square holes, openings, apertures, and/or receptacles sized to substantially match the size and shape of the frame retaining hooks 620 of the decorative cover frame 604. The hook retaining features 634 may pass completely through the backplate body 632, such that a rear of the backplate body 632 may provide a surface that retains a portion of the frame retaining hook 620 when the decorative concealed outlet device 200 including the decorative cover frame 604 is engaged with the hook interface backplate 630. The hook interface backplate 630 may include a backplate outlet aperture 640 configured to receive, surround, and/or emborder an outlet 112 (e.g., an electrical outlet, communications outlet, switch, etc.), or a portion of an outlet 112, as described herein.

Figure 7C:
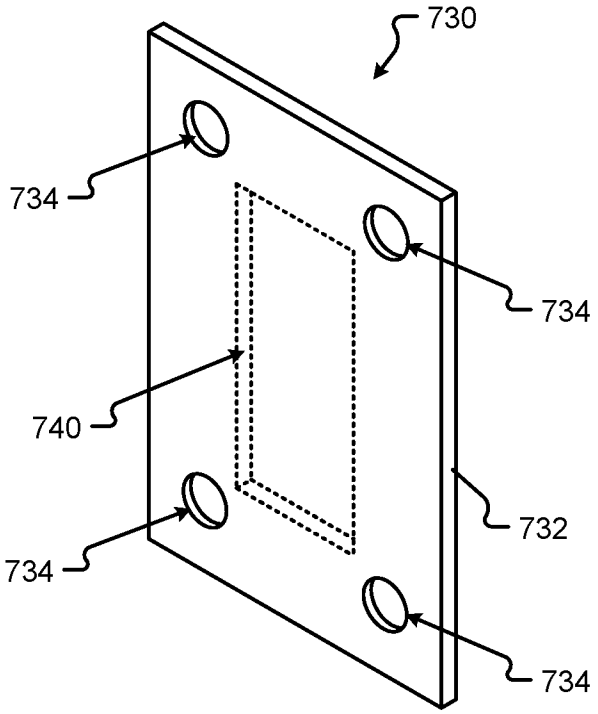
FIG. 7C shows a perspective view of a mating outlet cover plate for the decorative cover frame shown in FIGS. 7A and 7B.
Figure 7B:
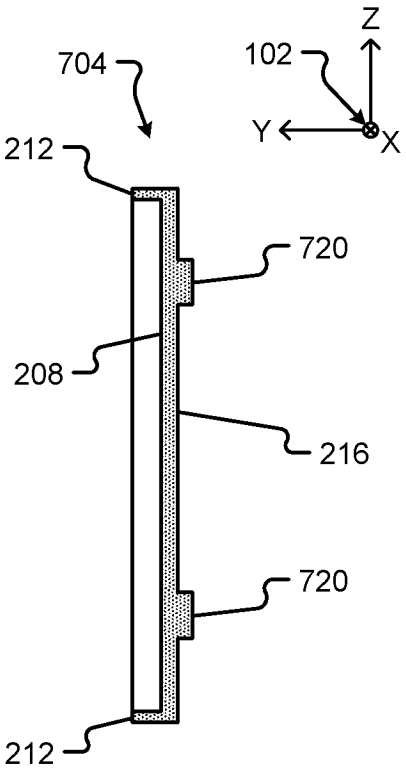
FIG. 7B shows a section elevation view of the decorative cover frame of FIG. 7A taken through line F-F.
Figure 7A:
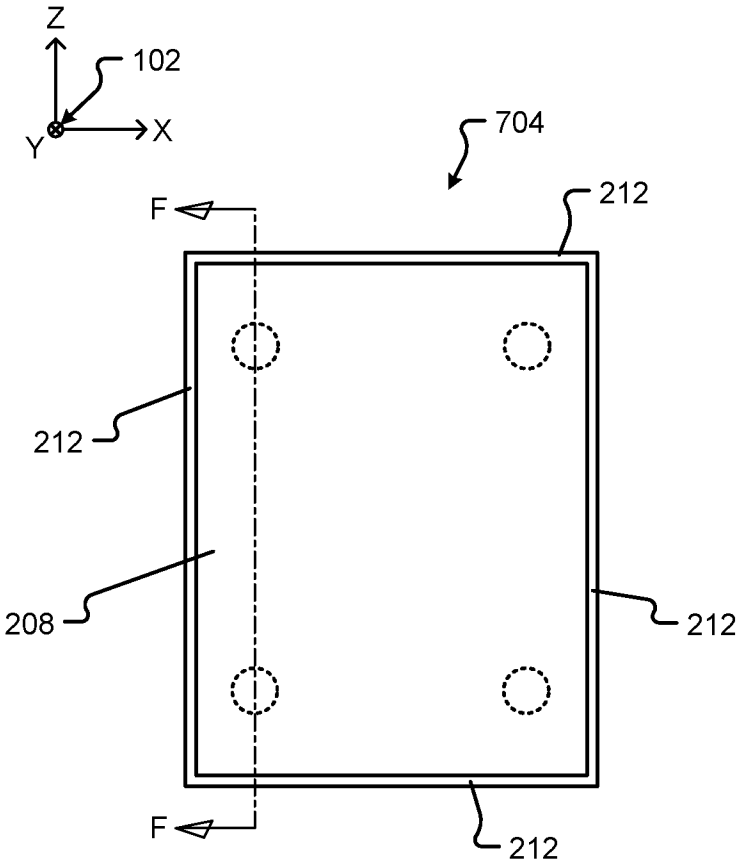
FIG. 7A shows an elevation view of a decorative cover frame of the decorative concealed outlet device in accordance with embodiments of the present disclosure.

FIG. 7A-7B show various views of a decorative cover frame 704 of the decorative concealed outlet device 200 in accordance with embodiments of the present disclosure. As can be appreciated, the decorative cover frame 704 of FIGS. 7A-7B may be fitted with a matched decorative element 206 and/or an adhesive element or adhesive layer 210 to form a decorative concealed outlet device 200. The features of the decorative cover frame 704 may be similar, if not identical, to the features described in conjunction with the decorative cover frame 204, 404, 504 of FIGS. 3A-3B, 4A-4B, and 5A-5C, or vice versa. The decorative cover frame 704 may include an optional rear frame recess 224 as described in conjunction with FIGS. 3A-3B. In some embodiments, the decorative cover frame 704 may be used to cover a switch, or switching element, style of outlet. In these embodiments, the rear frame recess 224 may receive a portion of the switch or switching element. In some embodiments, the rear frame recess 224 may allow the decorative cover frame 704 to cover or conceal the switch or switching element while simultaneously providing clearance between the decorative cover frame 704 and the switch or switching element of the outlet disposed at least partially inside the rear frame recess 224.

In some embodiments, the decorative cover frame 704 and/or decorative concealed outlet device 200 including the decorative cover frame 704, may be engaged with a custom magnetic interface backplate 730 (described in conjunction with FIG. 7C) for an outlet 112 via one or more magnetic frame retaining features 720. The magnetic frame retaining features 720 may include a magnet, or magnetic element, attached to the decorative cover frame 704. In one embodiment, the magnet, or magnetic element, may be molded or embedded within the material forming the body and/or rear frame contact surface 216 of the decorative cover frame 704. In another embodiment, the magnet, or magnetic element, may be at least partially inserted into a portion of the material forming the body and/or rear frame contact surface 216 of the decorative cover frame 704.

In addition to including at least one magnetic feature, the magnetic frame retaining features 720 may include a physical protrusion, or portion of material, extending from the rear frame contact surface 216 of the decorative cover frame 704. Although shown as a cylindrical feature in FIGS. 7A-7B, this protrusion may include any shape extending in a direction away from the decorative element mount surface 208 and the rear frame contact surface 216. Among other things, this protrusion may be configured to engage with mating features (e.g., the magnetic feature receptacles 734) of a corresponding magnetic interface backplate 730 providing a positive location of the decorative cover frame 704 relative to the magnetic interface backplate 730.

Additionally or alternatively, the magnetic frame retaining features 720 of the decorative cover frame 704 may magnetically engage with corresponding receiving features in the magnetic interface backplate 730. The magnetic frame retaining features 720 and the magnetic feature receptacle 734 may each include a magnet, a magnetic element, and/or combinations thereof. The magnetic frame retaining features 720 of the decorative cover frame 704 may be matched to the magnetic feature receptacles 734 of the magnetic interface backplate 730. In one embodiment, one or more of the magnetic frame retaining features 720 may include a magnet, while one or more of the magnetic feature receptacles 734 in the magnetic interface backplate 730 may include a magnetic element (e.g., iron, steel, etc., and/or combinations thereof). In another embodiment, one or more of the magnetic frame retaining features 720 may include a magnet and one or more of the magnetic feature receptacles 734 in the magnetic interface backplate 730 may also include a magnet. In this embodiment, the poles of the magnets in the decorative cover frame 704 may be arranged with the poles of the magnetic interface backplate 730 to provide an attraction force when brought in close proximity with one another (e.g., a north pole of the magnet in at least one magnetic frame retaining feature 720 may be aligned with a south pole of the magnet in at least one magnetic feature receptacle 734, and/or vice versa). In yet another embodiment, one or more of the magnetic frame retaining features 720 may include a magnetic element (e.g., iron, steel, etc., and/or combinations thereof), while one or more of the magnetic feature receptacles 734 in the magnetic interface backplate 730 may include a magnet. As can be appreciated, the decorative cover frame 704 may include combinations of magnets and magnetic elements in various magnetic frame retaining features 720 and/or positions, while the magnetic interface backplate 730 may include corresponding mating combinations of magnets and magnetic elements in various magnetic feature receptacles 734.

The magnets may include, but are in no way limited to permanent, or rare earth, magnets such as samarium-cobalt, neodymium, aluminum-nickel-cobalt, neodymium-iron-boron, etc., and/or combinations thereof. The magnets may be designed with a sufficient pull force to maintain a decorative concealed outlet device 200 having the decorative cover frame 704 against, or in contact with, a magnetic interface backplate 730 at least along the Y-axis direction (when concealing an outlet 112).

FIG. 7C shows a perspective view of a mating outlet cover plate, or magnetic interface backplate 730, for the decorative cover frame 704 shown in FIGS. 7A and 7B. In particular, the magnetic interface backplate 730 may include a backplate body 732 including a number of magnetic feature receptacles 734. In some embodiments, the magnetic feature receptacles 734 may be configured as blind holes, cutouts, openings, apertures, and/or receptacles sized to substantially match the size and shape of the magnetic frame retaining features 720 of the decorative cover frame 704. The magnetic frame retaining features 720 may engage with or insert, at least partially, into the backplate body 732 at the magnetic feature receptacles 734. One or more of the magnetic feature receptacles 734 may include a magnet or magnetic element as described above. The magnetic interface backplate 730 may include a backplate outlet aperture 740 configured to receive, surround, and/or emborder an outlet 112 (e.g., an electrical outlet, communications outlet, switch, etc.), or a portion of an outlet 112, as described herein.

Figure 8C:
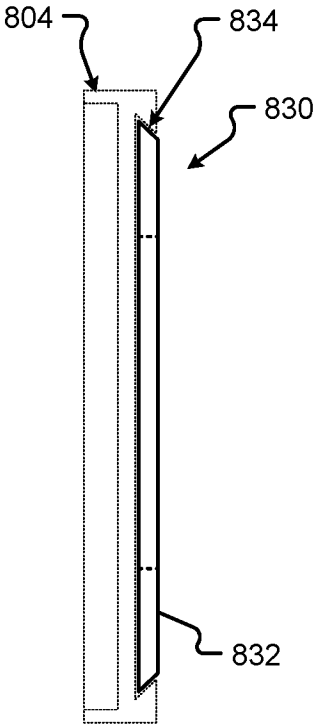
FIG. 8C shows a perspective view of a mating outlet cover plate for the decorative cover frame shown in FIGS. 8A and 8B.
Figure 8B:
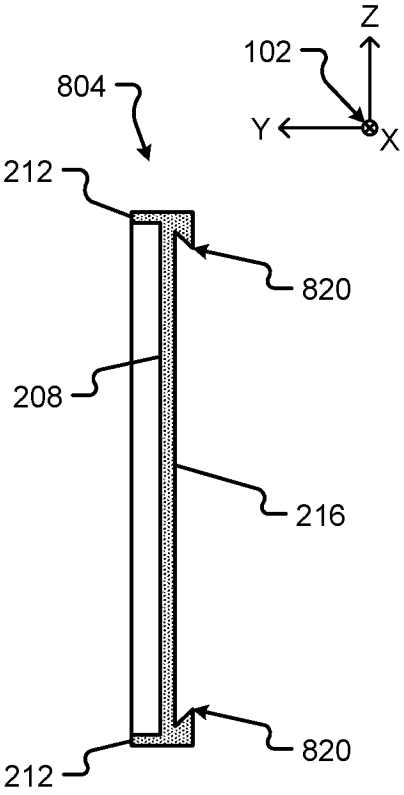
FIG. 8B shows a section elevation view of the decorative cover frame of FIG. 8A taken through line G-G.
Figure 8A:
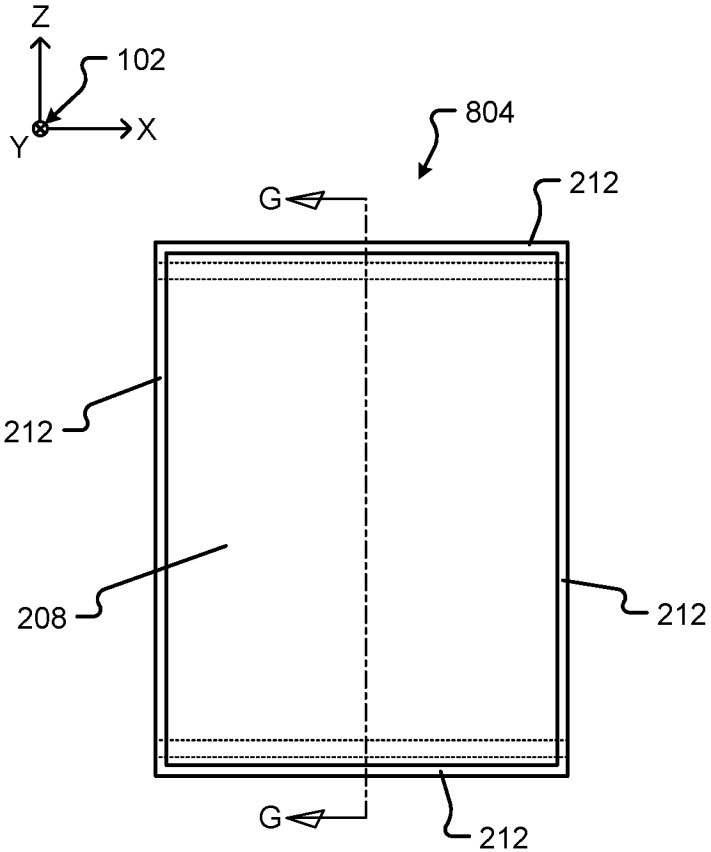
FIG. 8A shows an elevation view of a decorative cover frame of the decorative concealed outlet device in accordance with embodiments of the present disclosure.

FIG. 8A-8B show various views of a decorative cover frame 804 of the decorative concealed outlet device 200 in accordance with embodiments of the present disclosure. As can be appreciated, the decorative cover frame 804 of FIGS. 8A-8B may be fitted with a matched decorative element 206 and/or an adhesive element or adhesive layer 210 to form a decorative concealed outlet device 200. The features of the decorative cover frame 804 may be similar, if not identical, to the features described in conjunction with the decorative cover frame 204, 404, 504 of FIGS. 3A-3B, 4A-4B, and 5A-5C, or vice versa. The decorative cover frame 804 may include an optional rear frame recess 224 as described in conjunction with FIGS. 3A-3B. In some embodiments, the decorative cover frame 804 may be used to cover a switch, or switching element, style of outlet. In these embodiments, the rear frame recess 224 may receive a portion of the switch or switching element. In some embodiments, the rear frame recess 224 may allow the decorative cover frame 804 to cover or conceal the switch or switching element while simultaneously providing clearance between the decorative cover frame 804 and the switch or switching element of the outlet disposed at least partially inside the rear frame recess 224.

As shown in FIG. 8B, the decorative cover frame 804 may include one or more frame retaining ledges 820 configured to interface with a retaining cleat 834 or feature associated with a custom ledge interface backplate 830 (described in conjunction with FIG. 8C). The frame retaining ledges 820 may extend a distance from the rear frame contact surface 216 in a direction away from the decorative element mount surface 208 and the rear frame contact surface 216. Additionally or alternatively, the frame retaining ledges 820 may be configured with a hooked, angled, curved, and/or tapered surface to retain the decorative concealed outlet device 200 having the decorative cover frame 804 when engaged with the ledge interface backplate 830. The frame retaining ledges 820 of the decorative cover frame 804 are shown in FIGS. 8A-8C as a "dovetail" feature. In this embodiment, the decorative cover frame 804 may be engaged with the ledge interface backplate 830 by aligning the frame retaining ledges 820 with the corresponding retaining cleats 834 of the ledge interface backplate 830 and sliding the decorative cover frame 804 along the X-axis direction and relative to the fixed ledge interface backplate 830 until the decorative cover frame 804 covers the ledge interface backplate 830 and outlet 112.

Similar to the other cover plates 530, 630, 730, etc., the ledge interface backplate 830 may include a ledge interface backplate 830 and a backplate outlet aperture passing therethrough. In some embodiments, the ledge interface backplate 830 may be designed to sit offset and protruding from the visible surface of the decorated area 104 such that the decorative cover frame 804 can be selectively engaged with and disengaged from the ledge interface backplate 830 without significant interference with the decorated area 104.

Figure 9B:
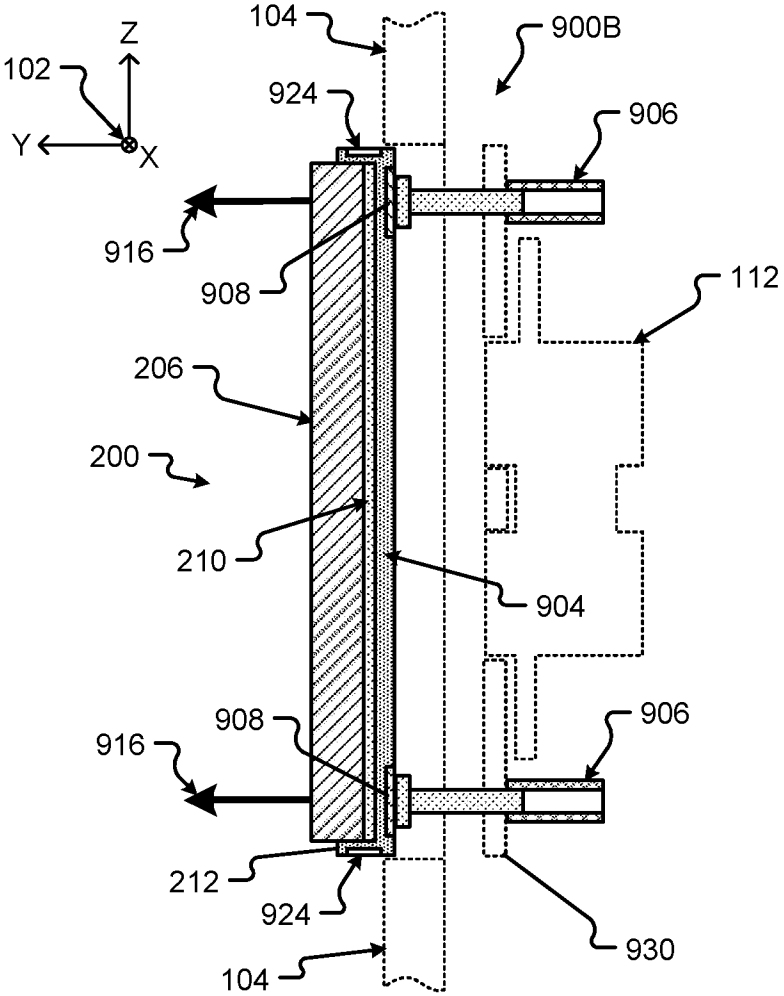
FIG. 9B shows a section elevation view of an embodiment of the decorative concealed outlet device of FIG. 9A after applying an ejection force thereto.
Figure 9A:
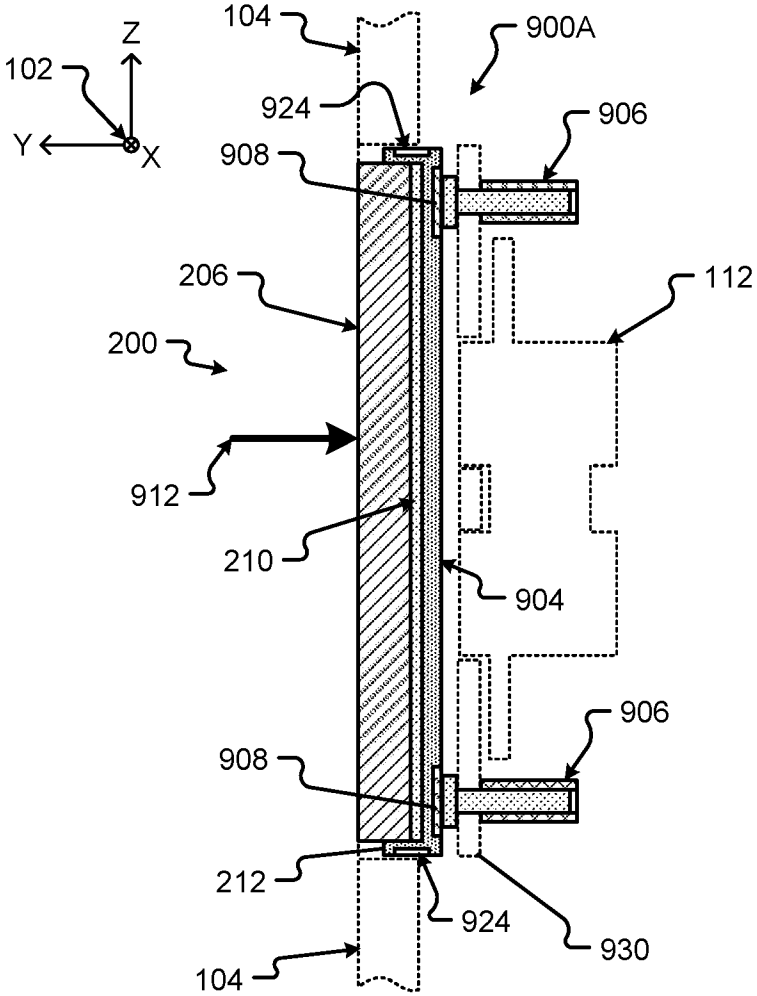
FIG. 9A shows a section elevation view of an embodiment of the decorative concealed outlet device engaged with an outlet interface plate.
Figure 9C:
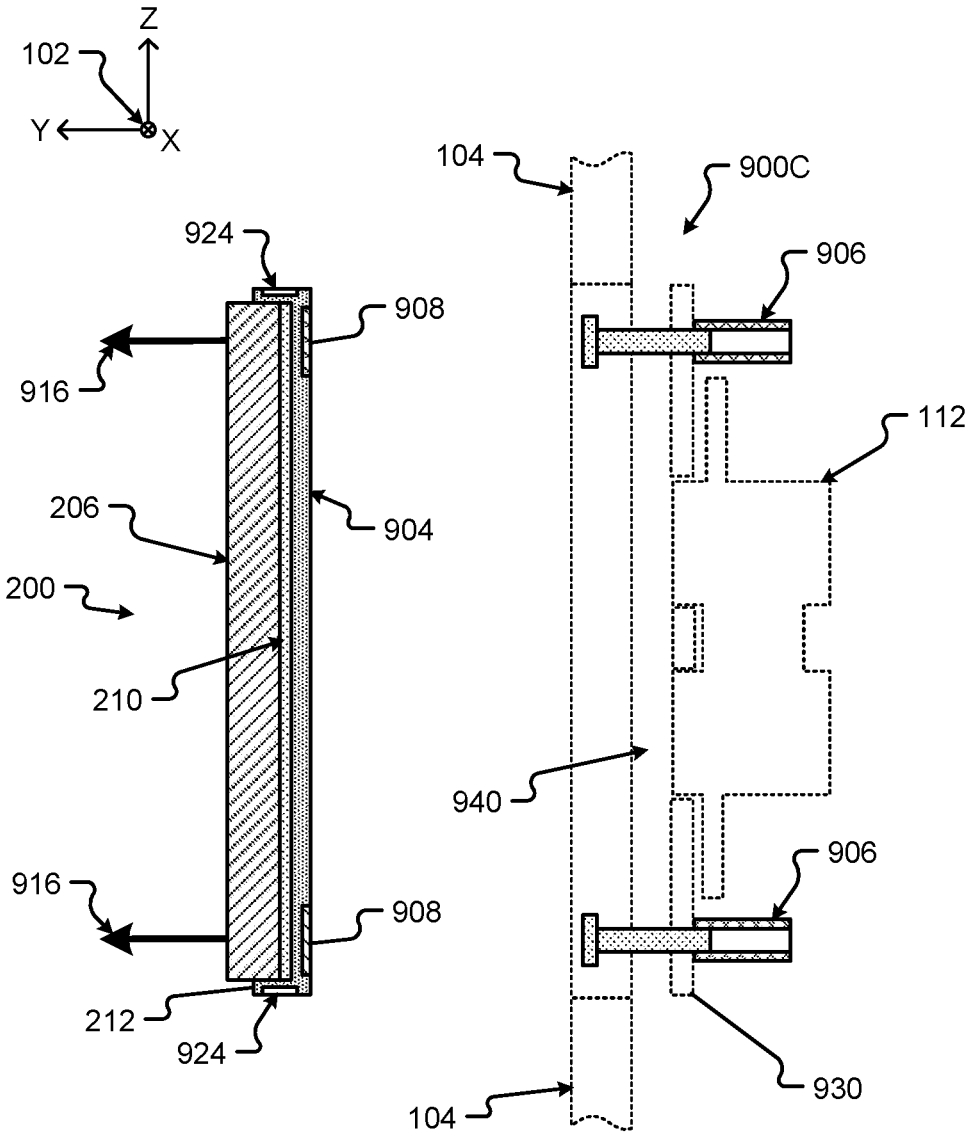
FIG. 9C shows a section elevation view of an embodiment of the decorative concealed outlet device of FIGS. 9A-9B removed from the outlet interface plate.

Referring now to FIGS. 9A-9C, various views of an embodiment of the decorative concealed outlet device 200 being engaged and disengaged with a touch-latch outlet interface plate 930 are shown in accordance with embodiments of the present disclosure. In particular, FIGS. 9A-9C show elevation section views of the decorative concealed outlet device 200 having a flush-mount frame 904 including touch-latch features 906 in various states 900A, 900B, 900C. These states include an outlet concealed state 900A, an outlet partially exposed state 900B, and an outlet exposed state 900C.

The flush-mount decorative cover frame 904 may include features that are similar, if not identical, to any one or more of the features of the decorative cover frames 204, 404, 504, 604, 704, 804, etc., described above. For instance, the flush-mount decorative cover frame 904 may include a decorative element mount surface 208, one or more peripheral ridges 212, and/or a rear frame contact surface 216. In some embodiments, the flush-mount decorative cover frame 904 may include one or more magnetic catches 908 designed to interact with corresponding magnetic features associated with the touch-latch 906 of the touch-latch outlet backplate 930. The magnetic catches 908 may be configured as a magnet, a magnetic element, and/or combination thereof. The corresponding magnetic features associated with the touch-latch 906 may be configured as a magnet, a magnetic element, and/or combination thereof, and configured to interact with the magnetic catches 908. In any event, the magnets and/or magnetic elements associated with the magnetic catches 908 and/or the corresponding magnetic features associated with the touch-latch 906 may be similar, if not identical, to the magnets and magnetic features of the magnetic frame retaining features 720 and magnetic feature receptacles 734 described in conjunction with decorative cover frame 704 and magnetic interface backplate 730 of FIGS. 7A-7C.

The flush-mount decorative cover frame 904 may include on or more grip features 924 arranged on a side of the flush-mount decorative cover frame 904 body. The grip features 924 may include, but are in no way limited to, one or more grooves, recesses, textured surfaces, scores, raised surfaces, and/or other interruption in the body of the flush-mount decorative cover frame 904. In some embodiments, a user may apply a tool, finger, fingernail, etc. to the grip features 924 to remove the decorative concealed outlet device 200 having the flush-mount decorative cover frame 904 from the touch-latches 906 of the outlet backplate 930. These grip features 924 may be disposed on one or more sides or surfaces of the other decorative cover frames 204, 404, 504, 604, 704, 804, etc. described herein.

The touch-latches 906 may include a spring-actuated mechanism having a compressed state (e.g., as shown in FIG. 9A) and an extended state (e.g., as shown in FIGS. 9B-9C). The touch-latches 906 may remain in the compressed state until a force is applied to the touch-latches 906 (e.g., via the decorative concealed outlet device 200) in actuation direction 912. Once the force has been applied, the touch-latches 906 may unlock from the compressed state and a spring therein may move a piston, or arm, from a retracted position in a body of the touch-latch 906 into an extended position at least partially extended from the body of the touch-latch 906 (as shown in FIGS. 9B-9C). As provided above, the actuating element (e.g., the piston, arm, etc.) of the touch-latch 906 may include a magnet and/or magnetic element disposed at an end thereof. In some embodiments, the touch-latches 906 may be embedded in, screwed into, and/or otherwise affixed to the outlet backplate 930.

When in the compressed state, the touch-latches 906 maintain the decorative concealed outlet device 200, and the visible surface of the matched decorative element 206, in a position flush, or substantially flush, with the visible surface of the decorated area 104 as shown in FIG. 9A. A user may apply a force (e.g., a push or touch) against the matched decorative element 206 in the actuation direction 912 to change the concealed state 900A of the outlet 112 (e.g., an electrical outlet, communications outlet, switch, etc.). In response to the applied force, the decorative concealed outlet device 200 may move in a deployment direction 916 as shown in FIG. 9B. In particular, the touch-latches 906 may extend moving from the compressed state to the extended state. In some embodiments, the decorative concealed outlet device 200 may be at least partially offset from the decorated area 104 in the partially exposed state 900B. In this position, the grip features 924 may be at least partially exposed such that a user may interface with the grip features 924 (e.g., to remove the decorative concealed outlet device 200 from the wall and the magnetic contacts located at the magnetic catches 908 and touch-latches 906). FIG. 9C shows the decorative concealed outlet device 200 having the flush-mount decorative cover frame 904 removed from the touch-latches 906 and the outlet opening 940 providing an outlet exposed state 900C. In the outlet exposed state 900C, a user may freely engage with and/or use the outlet 112 disposed in the wall.

FIGS. 10A-10D show various views of a flush-mount decorative concealed outlet device 1000 concealing an outlet 112 in accordance with embodiments of the present disclosure. The flush-mount decorative concealed outlet device 1000 may include a flush-mount cover frame 1004. The features of the flush-mount cover frame 1004 may be similar, if not identical, to the features described in conjunction with the decorative cover frames 204, 404, 504 of FIGS. 3A-3B, 4A-4B, and 5A-5C, or vice versa. The flush-mount cover frame 1004 may include an optional rear frame recess 224 as described in conjunction with FIGS. 3A-3B. In any event, the flush-mount cover frame 1004 and/or flush-mount decorative concealed outlet device 1000 having the flush-mount cover frame 1004, may be engaged with an outlet 112 and/or a backplate of an outlet 112 via one or more features (e.g., frame retaining protrusions 220, frame retaining hook 620, magnetic frame retaining features 720, frame retaining ledges 820, etc.) as described herein.

The flush-mount cover frame 1004 may include features that are similar, if not identical, to any one or more of the features of the decorative cover frames 204, 404, 504, 604, 704, 804, etc., described above. For instance, the flush-mount cover frame 1004 may include a decorative element mount surface 208, one or more peripheral ridges 212, and/or a rear frame contact surface 216. As can be appreciated, the flush-mount decorative concealed outlet device 1000 may be similar, if not identical, to the decorative concealed outlet device 200 as described herein. In some embodiments, the flush-mount cover frame 1004 may include a number of features to interface with a custom cover plate that are similar, if not identical, to those described in conjunction with the custom cover plates of FIGS. 6A-9C.

The flush-mount decorative concealed outlet device 1000 may include a pull pin 1008 configured to provide a feature and physical interface for a user to engage with in removing the flush-mount decorative concealed outlet device 1000 from a concealed position covering an outlet 112. In some embodiments, the pull pin 1008 may be disposed in a center of the flush-mount decorative concealed outlet device 1000 and/or the matched decorative element 206 of the flush-mount decorative concealed outlet device 1000. The pull pin 1008 may be made from a substantially, or at least partially, transparent, translucent, and/or clear material (e.g., plastic, etc.). Among other things, a translucent material can allow the pull pin 1008 to blend into its surroundings and/or allow the color or appearance of the pull pin 1008 to pass through the structure of the pull pin 1008.

In some embodiments, the pull pin 1008 may include a recessed state and an extended state. In the recessed stated, the pull pin 1008 may be disposed close to, or flush with, the visible surface of the matched decorative element 206 in the flush-mount decorative concealed outlet device 1000. In the extended state, the pull pin 1008 may be disposed further from the visible surface of the matched decorative element 206 than the recessed state. Being disposed further from the surface of the matched decorative element 206 may provide a user with a greater amount of material (e.g., of the pull pin 1008) for the user to grasp upon removing the flush-mount decorative concealed outlet device 1000 from concealing an outlet 112.

Figure 10A:
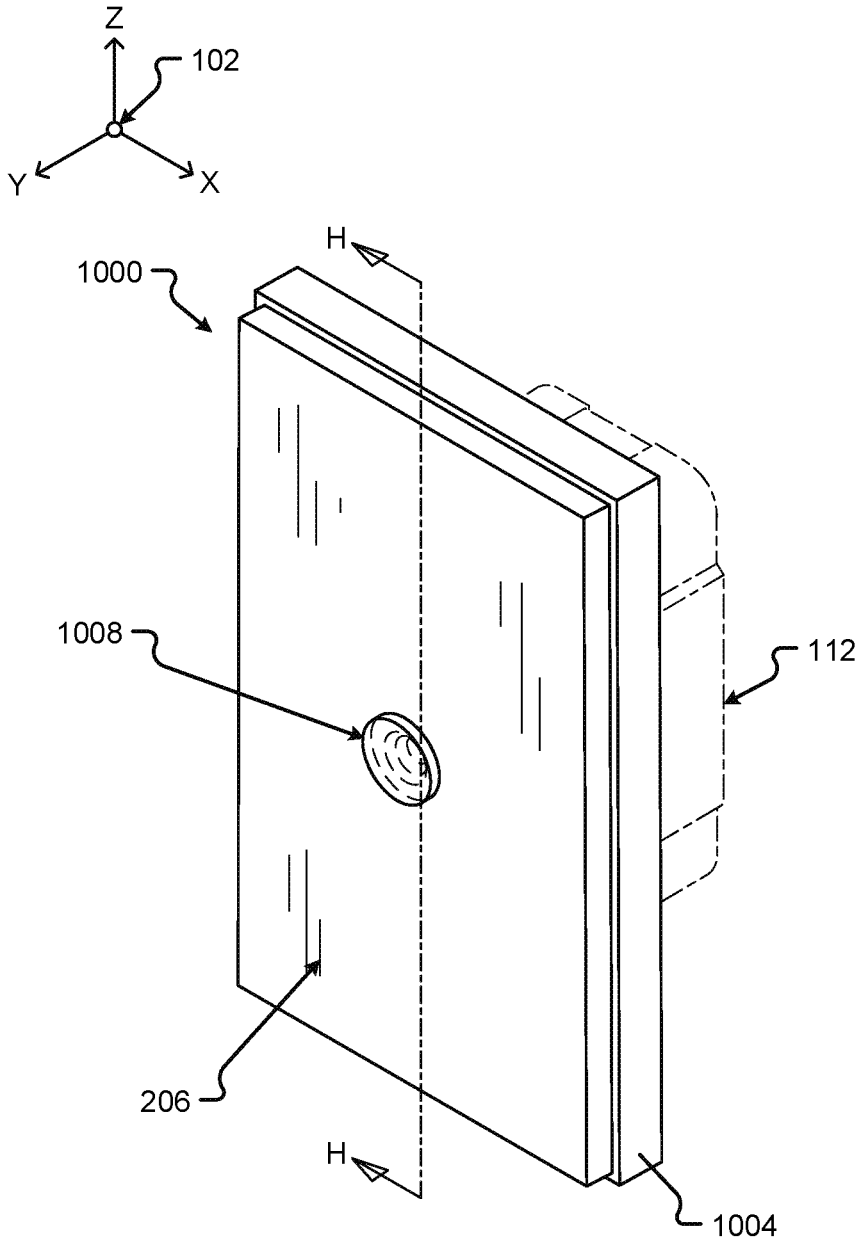
FIG. 10A shows a perspective view of a flush-mount decorative concealed outlet device and pull feature in accordance with embodiments of the present disclosure.
Figure 10B:
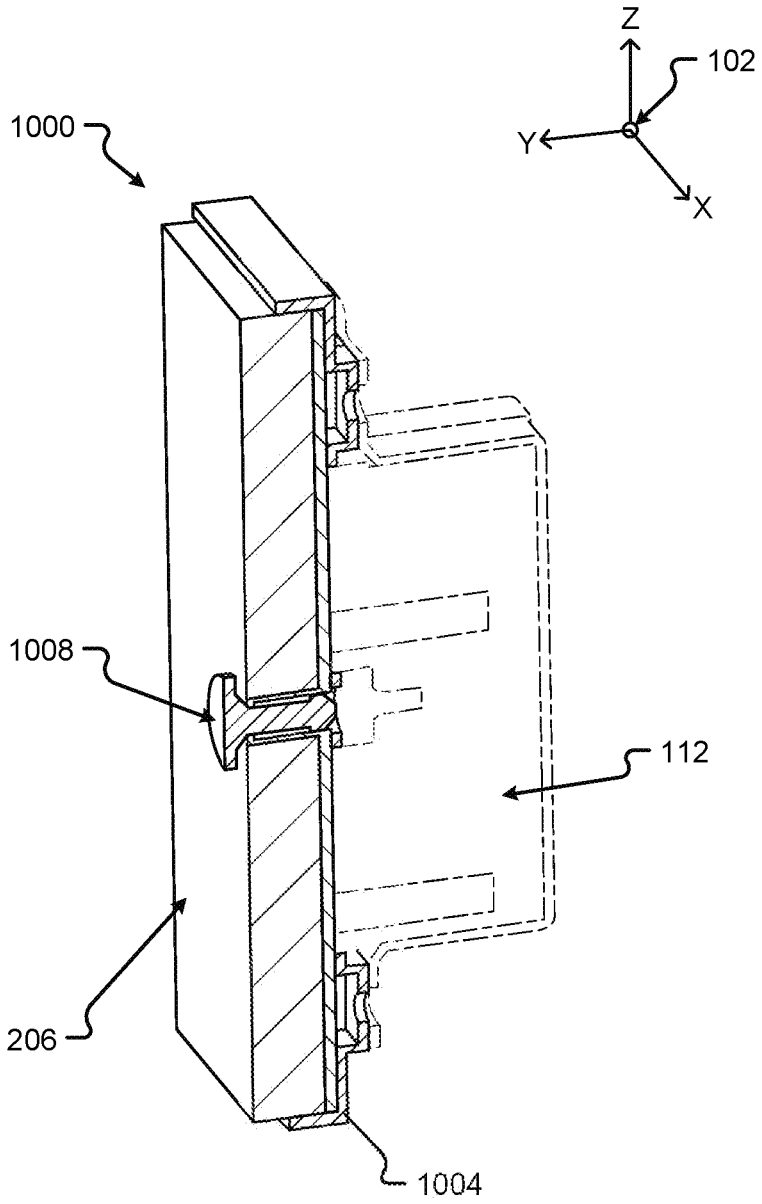
FIG. 10B shows a perspective section view of the flush-mount decorative concealed outlet device of FIG. 10A taken through line H-H.
Figure 10D:
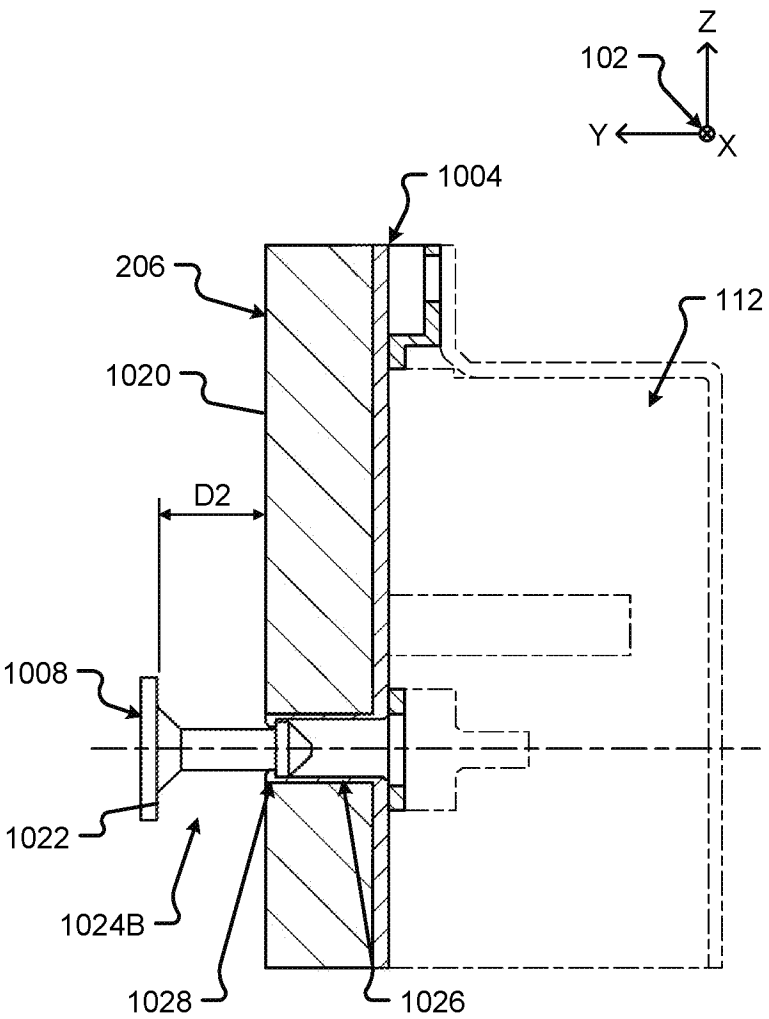
FIG. 10D shows a detail section view of the flush-mount decorative concealed outlet device of FIGS. 10A-10B in a second installation state.
Figure 10C:
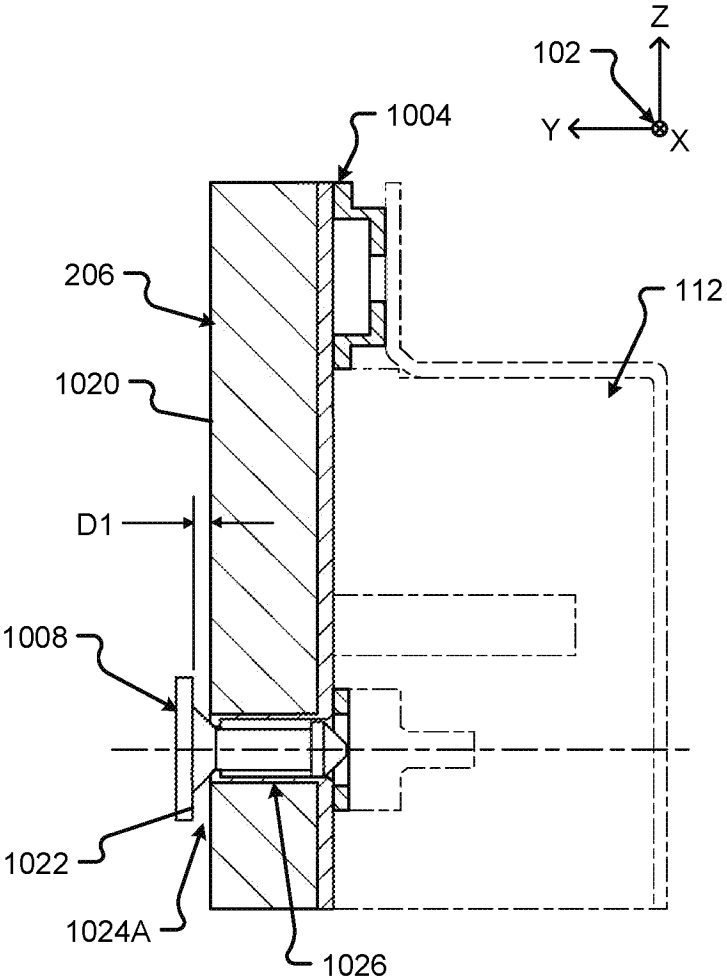
FIG. 10C shows a detail section view of the flush-mount decorative concealed outlet device of FIGS. 10A-10B in a first installation state.

FIGS. 10C-10D show detail section views of the flush-mount decorative concealed outlet device 1000 of FIGS. 10A-10B in a first and second installation state, respectively. As shown in FIG. 10C, the pull pin 1008 is positioned in the recessed state. In the recessed state, the pull pin 1008 is offset a minimal distance from the decorative element front surface 1020. More specifically, the pin head rear surface 1022 is disposed at a first pull pin head offset distance, D1, from the decorative element front surface 1020. In this position, a user may gain access to a first pull area 1024A between the pin head rear surface 1022 and the decorative element front surface 1020.

A portion of the pull pin 1008 is shown disposed in a cover frame translation channel 1026 of the flush-mount decorative concealed outlet device 1000. In some embodiments, the cover frame translation channel 1026 may be formed in a material of the flush-mount cover frame 1004. The pull pin 1008 may be configured to translate along the Y-axis direction as the pull pin 1008 moves relative to the cover frame translation channel 1026. In some embodiments, the cover frame translation channel 1026 may include a translation stop feature 1028 disposed at an end of the cover frame translation channel 1026. The translation stop feature 1028 may prevent the pull pin 1008 from being removed from the flush-mount decorative concealed outlet device 1000.

As a user engages with the first pull area 1024A (e.g., via inserting a fingertip, fingernail, and/or a tool, etc.), the pull pin 1008 may be pulled along the Y-axis direction. As shown in FIG. 10D, the pull pin 1008 is moved to a furthermost or extended position or state. In the extended state, the pull pin 1008 is offset a maximum distance from the decorative element front surface 1020. More specifically, the pin head rear surface 1022 is disposed at a second pull pin head offset distance, D2, from the decorative element front surface 1020. In this position, a user may gain access to an expanded pull area 1024B between the pin head rear surface 1022 and the decorative element front surface 1020. As shown in FIGS. 10C-10D, the second pull pin head offset distance, D2, is greater than the first pull pin head offset distance, D1. From the position of the pull pin 1008 shown in FIG. 10D, the flush-mount decorative concealed outlet device 1000 may be easily removed from an outlet 112 or outlet cover plate. Once the flush-mount decorative concealed outlet device 1000 is removed, a user may access the revealed outlet (e.g., an electrical outlet, communications outlet, switch, etc.) as described herein.

Figure 11:
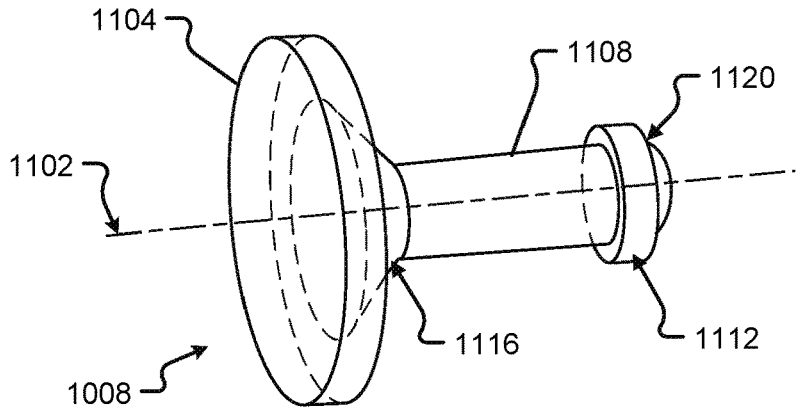
FIG. 11 shows a perspective view of a pull pin in accordance with embodiments of the present disclosure.

FIG. 11 shows a perspective view of the pull pin 1008 in accordance with embodiments of the present disclosure. As illustrated in FIGS. 10A-11, the pull pin 1008 may include a head 1104, a barrel 1108, a retaining ridge 1112, a taper 1116, and/or a lead-in 1120. In some embodiments, these features may be substantially centerline symmetrical (e.g., in revolution, etc.) about the center axis 1102 of the pull pin 1008. When inserted into, and/or attached to, the flush-mount cover frame 1004, the barrel 1108 of the pull pin 1008 may be disposed at least partially inside the cover frame translation channel 1026. As the pull pin 1008 is moved within the cover frame translation channel 1026 from the recessed state to the extended state, the retaining ridge 1112 of the pull pin 1008 may engage with or contact the translation stop feature 1028 of the cover frame translation channel 1026. This contact may prevent the pull pin 1008 from being removed from the flush-mount decorative concealed outlet device 1000. Additionally or alternatively, this contact may allow a user to pull the pull pin 1008 at the pull area 1024B and move the flush-mount decorative concealed outlet device 1000 from an engaged position with an outlet 112 to an outlet revealed position.

Figure 12:
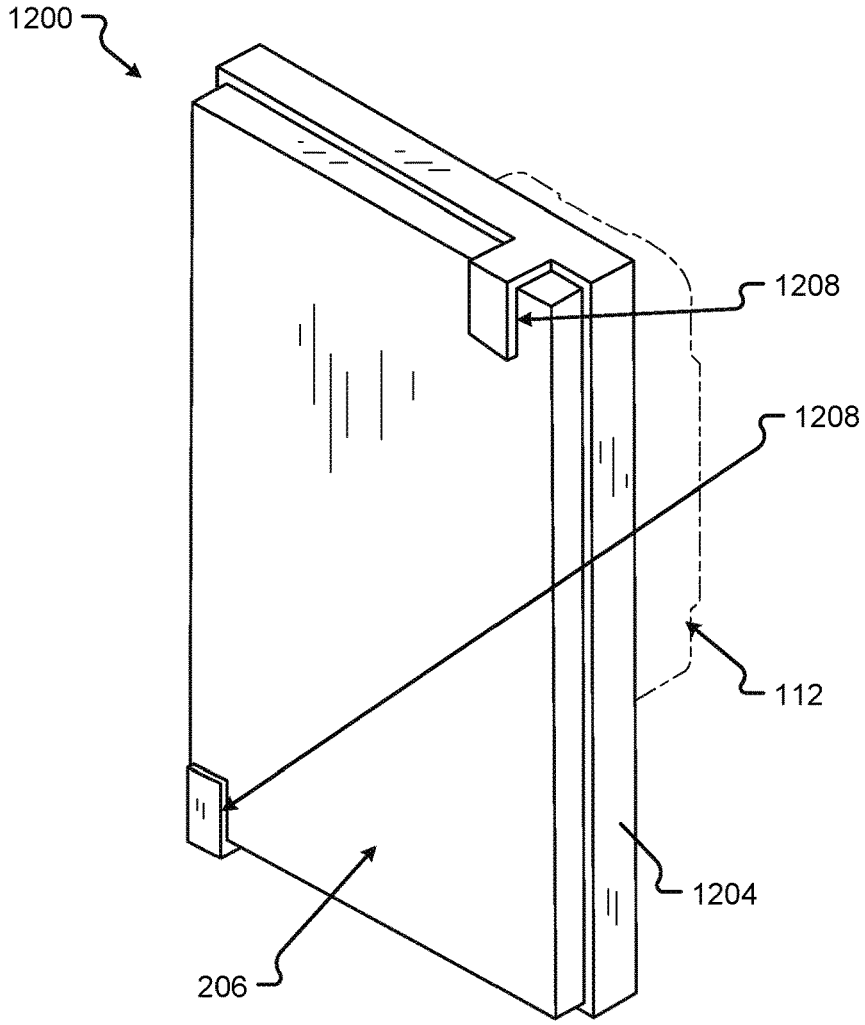
FIG. 12 shows a perspective view of a flush-mount decorative concealed outlet device and pull features in accordance with embodiments of the present disclosure.

FIG. 12 shows a perspective view of a flush-mount decorative concealed outlet device 1200 and pull features 1208 in accordance with embodiments of the present disclosure. As illustrated in FIG. 12, the decorative cover frame 1204 may include one or more device removal tabs 1208 extending from a body of the decorative cover frame 1204 to a position in front of the matched decorative element 206 disposed in the flush-mount decorative concealed outlet device 1200. These device removal tabs 1208 may be grasped by a user to remove the flush-mount decorative concealed outlet device 1200 from an engaged position with an outlet 112.

Figure 13B:
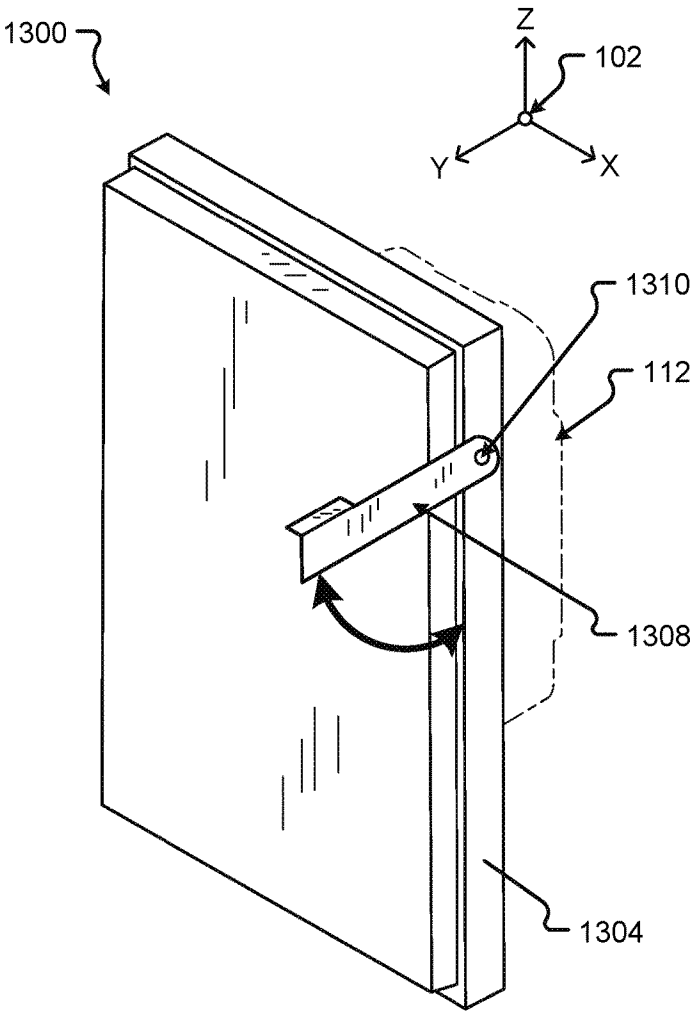
FIG. 13B shows a perspective view of the flush-mount decorative concealed outlet device of FIG. 13A with the pivoting pull feature in a second state in accordance with embodiments of the present disclosure.
Figure 13A:
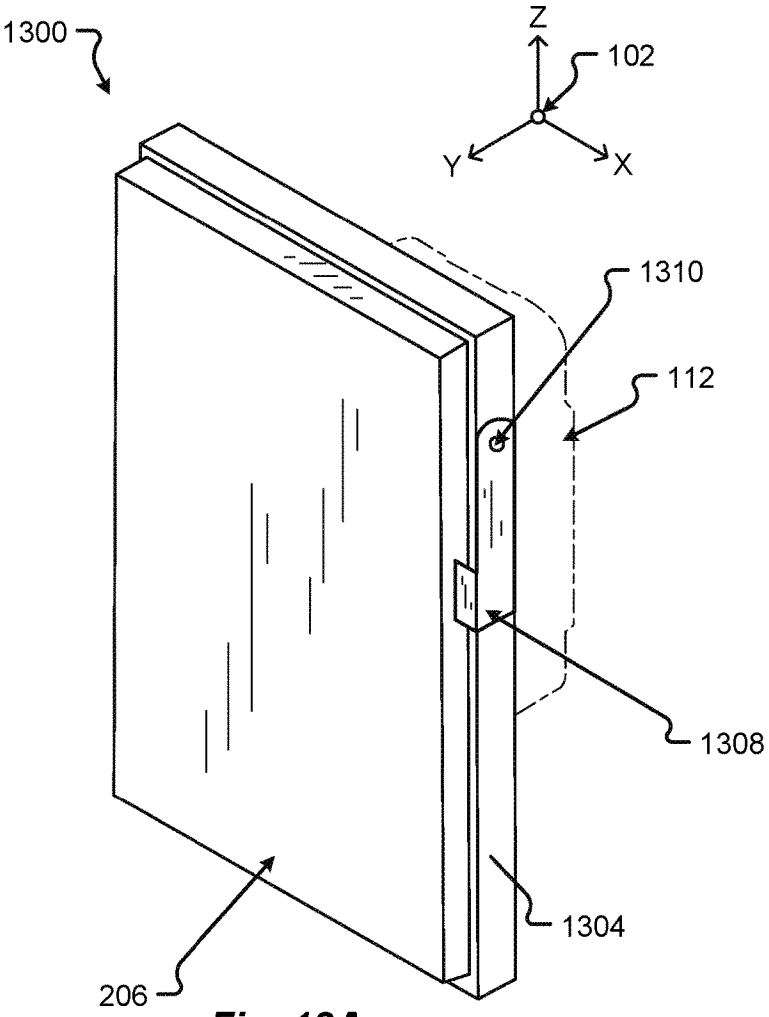
FIG. 13A shows a perspective view of a flush-mount decorative concealed outlet device with a pivoting pull feature in a first state in accordance with embodiments of the present disclosure.

FIGS. 13A-13B show perspective views of a flush-mount decorative concealed outlet device with a pivoting pull feature 1308 in a first and second state, respectively, in accordance with embodiments of the present disclosure. In some embodiments, the flush-mount decorative concealed outlet device 1300 may include one or more discrete pivoting pull tabs 1308 that, in a retracted state, provide a portion of material that does not protrude from the front visible surface of the matched decorative element 206. In these embodiments, the pivoting pull tabs 1308 may be moved from a retracted state (as shown in FIG. 13A) to a pivoted, or extended, state (as shown in FIG. 13B) by pivoting the pivoting pull tabs 1308 about a pivot point 1310. In one embodiment, the pivot point 1310 may be a pin that the pivoting pull tabs 1308 may move about. In another embodiment, the pivot point 1310 may define an area of a live hinge, or flexible point, of the pivoting pull tabs 1308, about which, the pivoting pull tabs 1308 may pivot or rotate.

In any event, the pivoting pull tab 1308 shown in FIGS. 13A-13B may be moved from a hidden, or partially hidden, position (as shown in FIG. 13A) to an exposed position by rotating the pivoting pull tabs 1308 about the X-axis translating a gripping portion of the pivoting pull tab 1308 in the YZ-plane into a position in front of the matched decorative element 206 (as shown in FIG. 13B). In one embodiment, the pivoting pull tab 1308 may be pried from the partially hidden position by inserting a tool, a fingertip, and/or a fingernail underneath a portion of the pivoting pull tab 1308, and pulling the pivoting pull tab 1308 outwardly along the YZ-plane about the X-axis at the pivot point 1310.

As the decorative concealed outlet devices 1000, 1200, 1300 may be mounted in a flush condition, the pull pin 1008, the device removal tab 1208, and/or the pivoting pull tabs 1308 may provide one or more exposed or accessible structures or surfaces that a user may contact when removing the devices 1000, 1200, 1300 from an outlet 112 (e.g., an outlet receptacle, a cover plate feature, etc.). As described in conjunction with any other decorative cover frame 204, 404, 504, 604, 704, 804, 904, etc., the flush-mount cover frames 1004, 1204, 1304 may be made from a substantially, or at least partially, transparent, translucent, and/or clear material. Further, any of the decorative cover frames 204, 404, 504, 604, 704, 804, 904, 1004, 1204, 1304, etc., described herein may be made from a nonconductive, insulative, and/or dielectric material.

Referring now to FIGS. 14A-14E, various views of a decorative cover frame 1404A, 1404B of the decorative concealed outlet device 200, 1000, 1200, 1300, etc. are shown in accordance with embodiments of the present disclosure. The decorative cover frame 1404A, 1404B shown in FIGS. 14A-14E may correspond to any one or more of the decorative cover frames 204, 404, 504, 604, 704, 804, 904, 1004, 1204, 1304, etc., described herein. For instance, it is an aspect of the present disclosure that the decorative cover frame 1404A, 1404B may include one or more score, break, or snap lines 1408, 1412 along portions of the peripheral ridges 212. Among other things, these snap lines 1408, 1412 may allow one or more of the peripheral ridges 212 to be snapped off of the decorative cover frame 1404A, 1404B. In one embodiment, one or more of the peripheral ridges 212 may be snapped off to allow a portion of the matched decorative element 206 (e.g., tile, wood, etc.) to extend beyond a periphery of the decorative cover frame 1404A, 1404B.

Figure 14B:
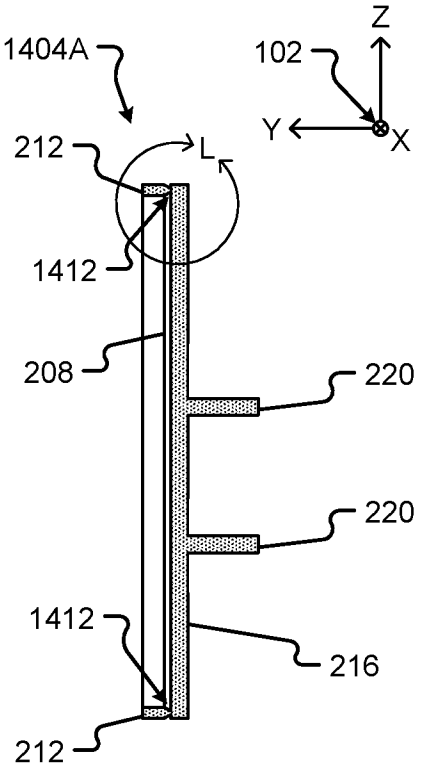
FIG. 14B shows a section elevation view of the decorative cover frame of FIG. 14A taken through line J-J.
Figure 14A:
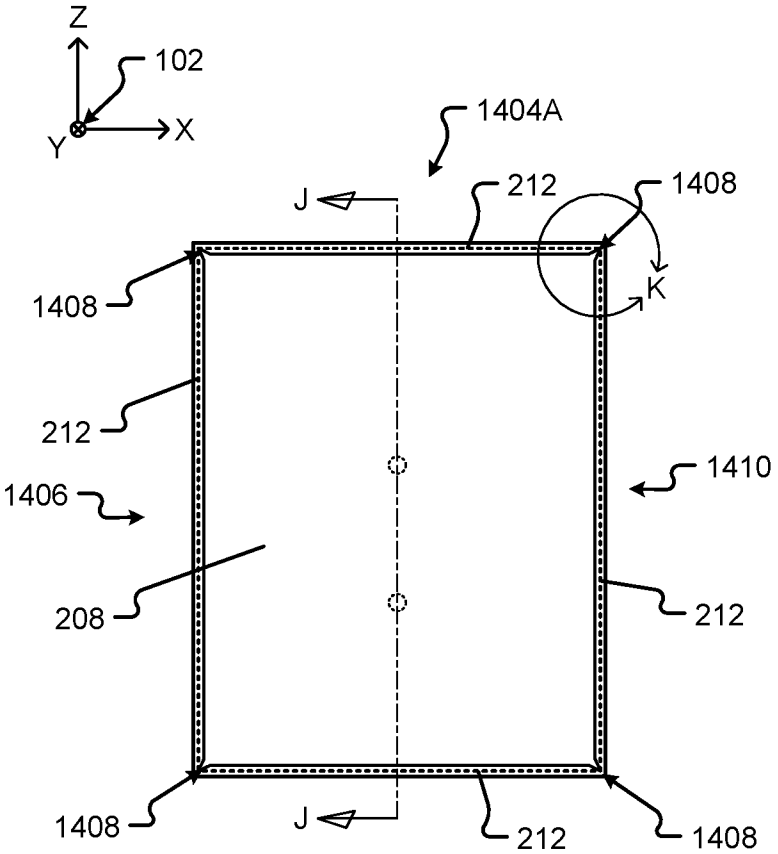
FIG. 14A shows an elevation view of a decorative cover frame of the decorative concealed outlet device in accordance with embodiments of the present disclosure.

FIG. 14A shows an elevation view of a decorative cover frame 1404A of the decorative concealed outlet device 200 in accordance with embodiments of the present disclosure. The decorative cover frame 1404A may include a body having a first side 1406 (e.g., a left side), a second side 1410 (e.g., a right side), and a number of peripheral ridges 212 extending around a periphery of the body. In some embodiments, the peripheral ridges 212 may emborder a decorative element mount surface 208. The peripheral ridges 212 may be molded or formed as joined elements extending from the decorative element mount surface 208 of the decorative cover frame 1404A body. Each peripheral ridge 212 may include a recessed or relieved amount of material along its length (e.g., width, height, etc.) and/or in a corner disposed between adjoining peripheral ridges 212. As shown in FIG. 14A, a corner relief 1408 is shown disposed at each corner of the decorative cover frame 1404A.

FIG. 14B shows a section elevation view of the decorative cover frame 1404A of FIG. 14A taken through line J-J. In FIG. 14B, the peripheral ridges 212 extending a length from the first side to the second side of the decorative cover frame 1404A are shown as including a relieved area 1412 of material along the length and disposed on one or more sides of the peripheral ridges 212. Similar relieved areas 1412 may run along the length of the peripheral ridges 212 extending from the top side of the decorative cover frame 1404A to the bottom side of the decorative cover frame 1404A.

Figure 14E:
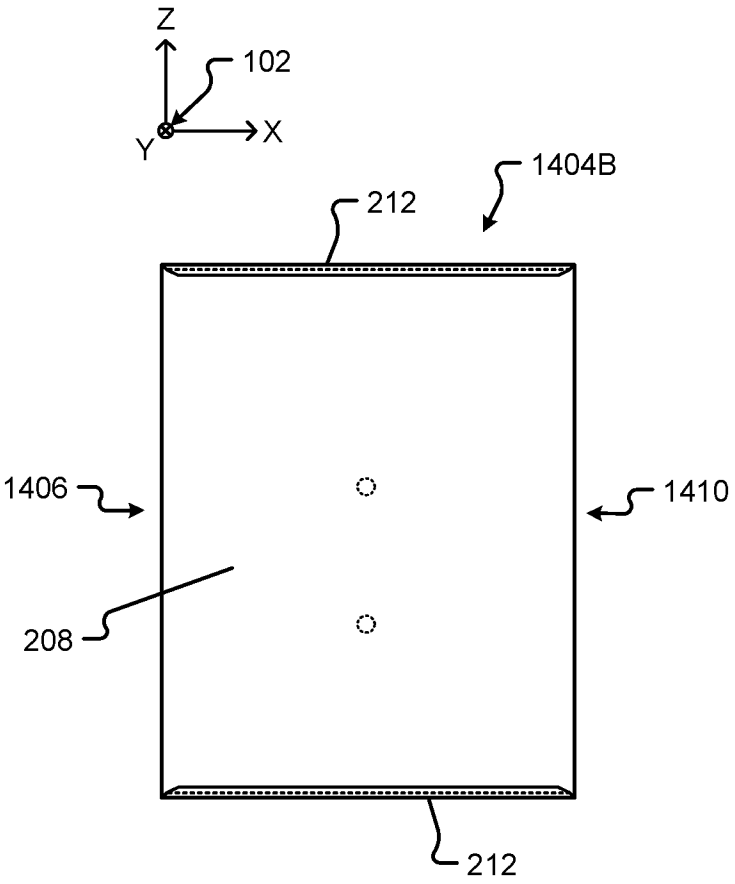
FIG. 14E shows an elevation view of the decorative cover frame with removed peripheral ridges in accordance with embodiments of the present disclosure.
Figure 14C:
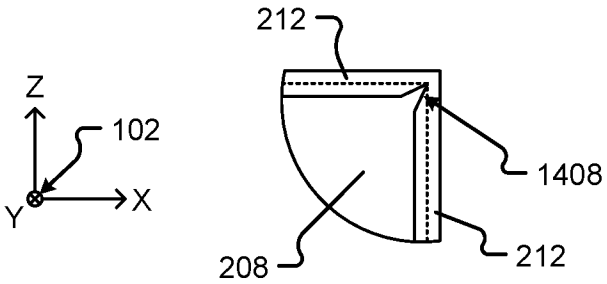
FIG. 14C shows a detail view of a corner of the decorative cover frame taken from circle K of FIG. 14A.

FIG. 14C shows a detail view of a corner of the decorative cover frame 1404A taken from circle K of FIG. 14A. As shown in FIG. 14C, the corner relief 1408 may include a tapered or recessed portion of material disposed at a corner of the decorative cover frame 1404A between adjacent and/or adjoining peripheral ridges 212. In some embodiments, the remaining amount of material joining one peripheral ridge 212 to an adjacent peripheral ridge 212 may be cut or torn at this corner relief 1408.

Figure 14D:
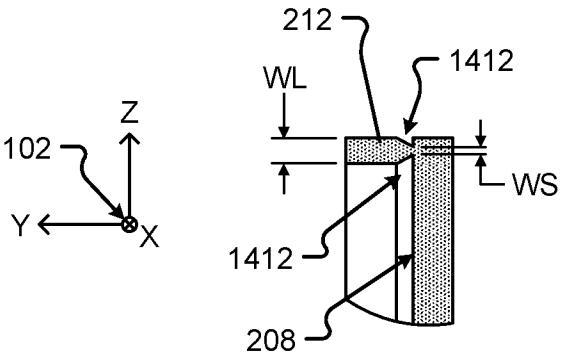
FIG. 14D shows a detail section view of a portion of a peripheral ridge of the decorative cover frame taken from circle L of FIG. 14B.

FIG. 14D shows a detail section view of a portion of a peripheral ridge 212 of the decorative cover frame 1404A taken from circle L of FIG. 14B. As shown in FIG. 14D, the peripheral ridge 212 includes a relieved area 1412 disposed along upper and lower portions of the length of the peripheral ridge 212. In some embodiments, these relieved areas 1412 may run along the entire length of a peripheral ridge 212 (e.g., along the X-axis direction shown in FIG. 14D). Whether configured as a single relieved area 1412, or multiple relieved areas 1412 (as shown in FIG. 14D), the relieved area 1412 alters a ridge width, WL, of the peripheral ridge 212 to a reduced, or smaller, ridge width, WS at a point where the peripheral ridge 212 meets the body of the decorative cover frame 1404A, or the decorative element mount surface 208. This thinned section provides a snap line along the length of each peripheral ridge 212.

In one embodiment, a user may cut opposing corners of the peripheral ridge 212 at the corner relief 1408 and then bend the peripheral ridge 212 back and forth, along its length, until the peripheral ridge 212 separates from the decorative cover frame 1404A. In some embodiments, a particular peripheral ridge 212 may be cut along the relieved area 1412 to separate the peripheral ridge 212 from the decorative element mount surface 208 or decorative cover frame 1404A body.

In FIG. 14E, an elevation view of the decorative cover frame 1404B having removed peripheral ridges 212 is shown in accordance with embodiments of the present disclosure. In particular, the peripheral ridge 212 running along the first and second sides 1406, 1410 are shown as removed. Among other things, this decorative cover frame 1404B allows a matched decorative element 206 to extend beyond the first and second sides 1406, 1410 of the decorative cover frame 1404B. This decorative cover frame 1404B may be especially useful where a matched decorative element 206 may need to blend into a surrounding decorated area 104 (e.g., staggered, offset, or other arrangement of tile, wood, etc.). Additionally or alternatively, this decorative cover frame 1404B may be employed where a single decorative cover frame 1404B may be used to cover multiple outlets 112, features, and/or objects associated with a decorated area 104.

Figure 15:
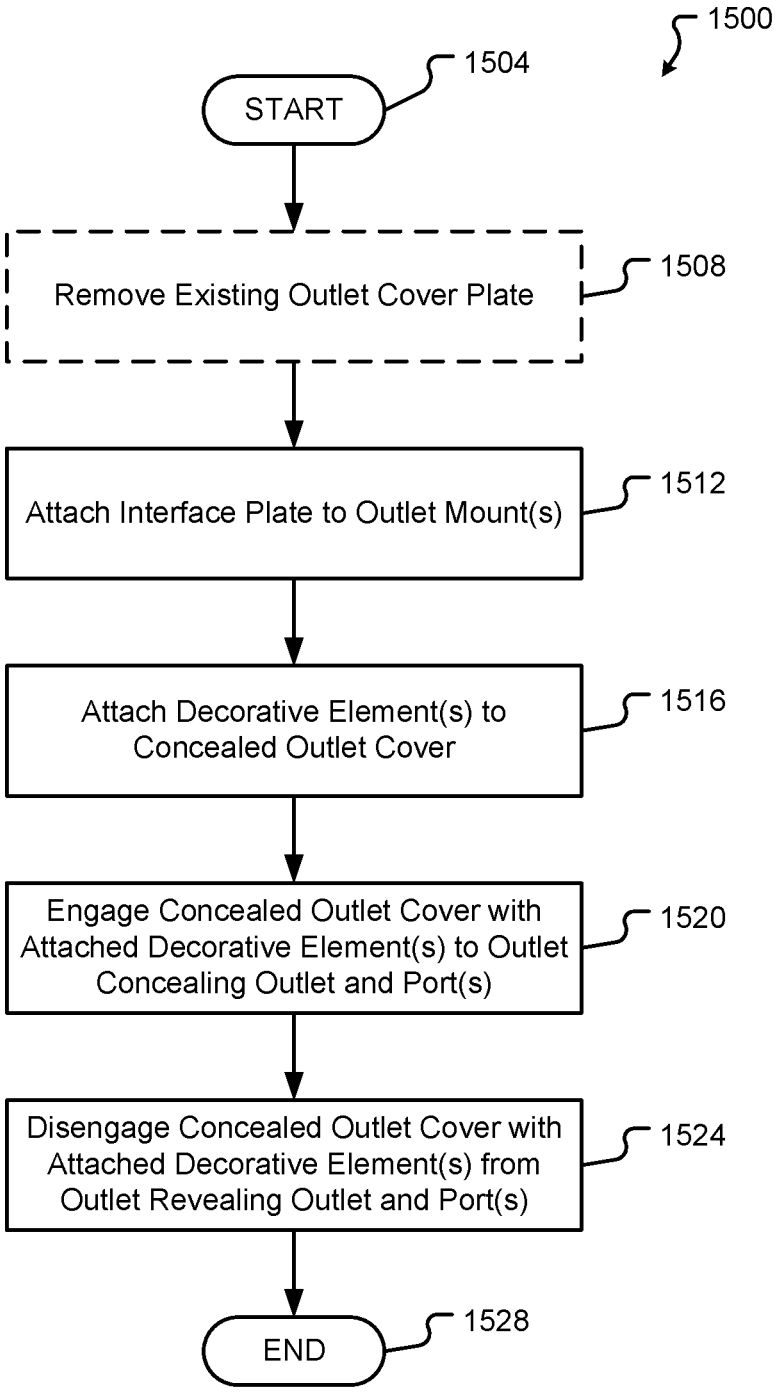
FIG. 15 is a flow diagram of a method for selectively concealing and revealing an outlet with a decorative concealed outlet device in accordance with embodiments of the present disclosure.

FIG. 15 is a flow diagram of a method 1500 for selectively concealing and revealing an outlet 112 with a decorative concealed outlet device 200 in accordance with embodiments of the present disclosure. The method 1500 may begin at step 1504 and proceed by a user removing an existing outlet cover plate 120 from an installed position with an outlet 112 (step 1508). In some embodiments, this step may be required when retrofitting a decorative concealed outlet device 200 with a previously installed outlet 112 and outlet cover plate 120. The existing outlet cover plate 120 may be removed by unscrewing one or more mount features, prying a cover off of an outlet 112, and/or combinations thereof.

The method 1500 may continue by the user attaching an interface plate to the mount points of an outlet 112 (step 1512). In some embodiments, the interface plate may correspond to the backplates 530, 630, 730, 830, 930, etc., described in conjunction with FIGS. 5A-9C and herein. In one embodiment, the decorative concealed outlet device 200 may be matched to a custom interface plate to form a decorative concealed outlet assembly. The interface plate may be screwed into and/or clipped onto the exiting mount features of one or more outlets 112.

Next, the method 1500 may proceed by the user attaching the matched decorative element 206 to the concealed outlet cover, or decorative cover frame 204 (step 1516). In some embodiments, this attachment may include adhering the matched decorative element 206 to a decorative element mount surface 208 of the decorative cover frame 204 of the decorative concealed outlet device 200. As provided above, the adhesive may include, but is in no way limited to, construction adhesive, thinset mortar, glue, caulk, grout, tape, hook-and-loop fasteners, mechanical fasteners, polymer adhesives, compounds, etc., and/or combinations thereof.

Once the adhesive has set, the decorative concealed outlet device 200 may be engaged with an outlet 112 and/or the interface plate to conceal the outlet 112 and one or more outlet ports 116 of the outlet 112 (step 1520). In some embodiments, the decorative concealed outlet device 200 may completely cover all outlet ports 116 of the outlet 112 and conceal the outlet 112 from view. The matched decorative element 206 of the decorative concealed outlet device 200 may hide or otherwise camouflage the outlet 112 or the existence of an outlet 112 in a wall or decorated area 104.

When access to the concealed outlet 112 is desired, the user may disengage the decorative concealed outlet device 200 from the concealed position revealing the outlet 112 (step 1524). In some embodiments, this disengagement may fully separate the decorative concealed outlet device 200 from the outlet 112 and/or the interface plate. In one embodiment, the decorative concealed outlet device 200 may remain attached to the outlet 112 and/or the interface plate while still providing usable access to the outlet ports 116 of the outlet 112. For instance, the decorative concealed outlet device 200 may be hinged outwardly away from the wall to expose the outlet 112 in the revealed position. As can be appreciated, the decorative concealed outlet device 200 may be selectively engaged or disengaged from an outlet 112 and/or interface plate to conceal or reveal a camouflaged outlet as desired by a user. In any of the embodiments described herein, once the decorative concealed outlet device 200, 1000, 1200, 1300, has been removed from a cover-concealed position, a user may access the revealed outlet (e.g., an electrical outlet, communications outlet, switch, etc.), as described herein. The method 1500 may end at step 1528.

The exemplary systems and methods of this disclosure have been described in relation to methods and devices to conceal and/or disguise outlets. However, to avoid unnecessarily obscuring the present disclosure, the preceding description omits a number of known structures and devices. This omission is not to be construed as a limitation of the scope of the claimed disclosure. Specific details are set forth to provide an understanding of the present disclosure. It should, however, be appreciated that the present disclosure may be practiced in a variety of ways beyond the specific detail set forth herein.

In the appended figures, similar components and/or features may have the same reference label. Further, various components of the same type may be distinguished by following the reference label by a letter that distinguishes among the similar components. If only the first reference label is used in the specification, the description is applicable to any one of the similar components having the same first reference label irrespective of the second reference label.

References in the specification to "one embodiment," "an embodiment," "an example embodiment," "an exemplary embodiment," "some embodiments," "an aspect," etc., indicate that the embodiment described may include a particular feature, structure, step, or characteristic, but every embodiment may not necessarily include the particular feature, structure, step or characteristic as one or more of the particular features, structures, steps, or characteristics may be optional depending, for example, on a particular implementation or operational environment. Moreover, such phrases are not necessarily referring to the same embodiment. Further, when a particular feature, structure, step, or characteristic is described in conjunction with one embodiment, it is submitted that the description of such feature, structure, step or characteristic may apply to any one or more of the other embodiments described herein.

Also, while the flowcharts have been discussed and illustrated in relation to a particular sequence of events, it should be appreciated that changes, additions, and omissions to this sequence can occur without materially affecting the operation of the disclosed embodiments, configuration, and aspects.

A number of variations and modifications of the disclosure can be used. It would be possible to provide for some features of the disclosure without providing others.

The present disclosure, in various aspects, embodiments, and/or configurations, includes components, methods, processes, systems and/or apparatus substantially as depicted and described herein, including various aspects, embodiments, configurations embodiments, subcombinations, and/or subsets thereof. Those of skill in the art will understand how to make and use the disclosed aspects, embodiments, and/or configurations after understanding the present disclosure. The present disclosure, in various aspects, embodiments, and/or configurations, includes providing devices and processes in the absence of items not depicted and/or described herein or in various aspects, embodiments, and/or configurations hereof, including in the absence of such items as may have been used in previous devices or processes, e.g., for improving performance, achieving ease and/or reducing cost of implementation.

The foregoing discussion of the disclosure has been presented for purposes of illustration and description. The foregoing is not intended to limit the disclosure to the form or forms disclosed herein. In the foregoing Detailed Description for example, various features of the disclosure are grouped together in one or more embodiments, configurations, or aspects for the purpose of streamlining the disclosure. The features of the embodiments, configurations, or aspects of the disclosure may be combined in alternate embodiments, configurations, or aspects other than those discussed above. This method of disclosure is not to be interpreted as reflecting an intention that the claimed disclosure requires more features than are expressly recited in each claim. Rather, as the following claims reflect, inventive aspects lie in less than all features of a single foregoing disclosed embodiment, configuration, or aspect. Thus, the following claims are hereby incorporated into this Detailed Description, with each claim standing on its own as a separate preferred embodiment of the disclosure.

Moreover, though the description of the disclosure has included description of one or more embodiments, configurations, or aspects and certain variations and modifications, other variations, combinations, and modifications are within the scope of the disclosure, e.g., as may be within the skill and knowledge of those in the art, after understanding the present disclosure. It is intended to obtain rights, which include alternative embodiments, configurations, or aspects to the extent permitted, including alternate, interchangeable and/or equivalent structures, functions, ranges, or steps to those claimed, whether or not such alternate, interchangeable and/or equivalent structures, functions, ranges, or steps are disclosed herein, and without intending to publicly dedicate any patentable subject matter.

Embodiments include a method for camouflaging a wall outlet using a protective cover comprising: attaching a custom décor that matches the surrounding of the wall outlet to a front side of a protective cover; wherein the protective cover is made of a dielectric material; attaching a means for removing the protective cover; forming at least two prongs on an opposite side of the cover from the custom décor wherein, all of the prongs fit into slots on the wall outlet; and inserting the prongs of the protective cover into the wall outlet hiding the wall outlet from view.

Aspects of the above method include attaching a flat perimeter plate to the wall outlet before inserting the prongs into the wall outlet; wherein the flat perimeter plate will allow the protective cover to sit flush with the wall.

Embodiments include a decorative cover frame for completely concealing an appearance of an outlet in a decorated surface, comprising: a substantially planar body having a decorative element mount surface and an outlet facing surface disposed opposite the decorative element mount surface; a frame retaining protrusion extending outwardly from the outlet facing surface; and a decorative element support ridge extending outwardly from the decorative element mount surface along at least one peripheral edge of the substantially planar body.

Aspects of the above decorative cover frame include wherein the decorative element mount surface includes an interrupted surface feature providing an increased surface area for the decorative element mount surface compared to a smooth surface for the decorative element mount surface. Aspects of the above decorative cover frame include wherein the decorative element support ridge runs along all peripheral edges of the substantially planar body forming a recessed area disposed inside the peripheral edges, wherein the recessed area is configured to receive a decorative element matching a decorative element of the decorated surface. Aspects of the above decorative cover frame include wherein the decorative support ridge and the frame retaining protrusion are integrally formed from the substantially planar body, and wherein the substantially planar body is made from a nonconductive material. Aspects of the above decorative cover frame include wherein the nonconductive material is at least partially translucent. Aspects of the above decorative cover frame include wherein the frame retaining protrusion includes at least two separate protrusions, and wherein each protrusion of the at least two separate protrusions is sized to fit in a corresponding port of the outlet. Aspects of the above decorative cover frame include wherein a width of the decorative support ridge is reduced at points where the decorative support ridge meets the decorative element mount surface and at corners of the substantially planar body. Aspects of the above decorative cover frame include wherein a first portion of the decorative support ridge is removed from a first peripheral edge of the at least one peripheral edge of the substantially planar body. Aspects of the above decorative cover frame include wherein a second portion of the decorative support ridge is removed from a second peripheral edge of the at least one peripheral edge of the substantially planar body, and wherein the second peripheral edge is disposed on an opposite side of the substantially planar body from the first peripheral edge.

Embodiments include a decorative concealed outlet device for completely concealing an appearance of an outlet disposed in a decorated surface, comprising: a decorative cover frame, comprising: a substantially planar body having a decorative element mount surface and an outlet facing surface disposed opposite the decorative element mount surface; a frame retaining protrusion extending outwardly from the outlet facing surface; and a decorative element support ridge extending outwardly from the decorative element mount surface along at least one peripheral edge of the substantially planar body; a decorative element including a visible decorative surface matching a the decorated surface; and an adhesive layer arranged in the decorative cover frame in contact with the decorative element mount surface and in contact with the decorative element.

Aspects of the above decorative concealed outlet device include wherein the decorative element mount surface includes an interrupted surface feature providing an increased adhesive contact surface area for the adhesive layer to contact the decorative element mount surface compared to a smooth surface for the decorative element mount surface. Aspects of the above decorative concealed outlet device include wherein the decorative element support ridge runs along all peripheral edges of the substantially planar body forming a recessed area disposed inside the peripheral edges, and wherein the decorative element and the adhesive layer are at least partially disposed in the recessed area. Aspects of the above decorative concealed outlet device include wherein the decorative support ridge and the frame retaining protrusion are integrally formed from the substantially planar body, and wherein the substantially planar body is made from an at least partially translucent and nonconductive material. Aspects of the above decorative concealed outlet device include wherein the frame retaining protrusion includes at least two separate protrusions, and wherein each protrusion of the at least two separate protrusions is sized to fit in a corresponding port of the outlet. Aspects of the above decorative concealed outlet device include wherein a width of the decorative support ridge is reduced at points where the decorative support ridge meets the decorative element mount surface and at corners of the substantially planar body. Aspects of the above decorative concealed outlet device further comprise: a pull feature interconnected with the decorative cover frame and extending a distance beyond the decorative element. Aspects of the above decorative concealed outlet device include wherein the pull feature is moveable between a recessed state and an extended state, wherein in the extended state a greater area of the pull feature extends beyond the decorative element. Aspects of the above decorative concealed outlet device include wherein the pull feature is disposed at least partially within a translation channel disposed within the decorative cover frame, and wherein the pull feature is retained inside the translation channel by a translation stop feature disposed at an end of the translation channel. Aspects of the above decorative concealed outlet device include wherein a first portion of the decorative support ridge is removed from a first peripheral edge of the at least one peripheral edge of the substantially planar body, wherein a second portion of the decorative support ridge is removed from a second peripheral edge of the at least one peripheral edge of the substantially planar body, and wherein the second peripheral edge is disposed on an opposite side of the substantially planar body from the first peripheral edge.

Embodiments include a camouflaged protective wall outlet cover, comprising: a custom décor that matches surroundings of a wall outlet intended to be hidden from view that is attached to a front side of a protective cover, wherein the protective cover is composed of dielectric materials; a pull feature attached to the protective cover for physically removing the protective cover from an engaged position concealing the wall outlet; and at least two prongs, composed of dielectric material, attached on an opposite side of the front side of the protective cover and opposite the attached custom décor, wherein each of the prongs fit into receiving slots of the wall outlet.

Any one or more of the aspects/embodiments as substantially disclosed herein.

Any one or more of the aspects/embodiments as substantially disclosed herein optionally in combination with any one or more other aspects/embodiments as substantially disclosed herein.

One or more means adapted to perform any one or more of the above aspects/embodiments as substantially disclosed herein.

The phrases "at least one," "one or more," "or," and "and/or" are open-ended expressions that are both conjunctive and disjunctive in operation. For example, each of the expressions "at least one of A, B and C," "at least one of A, B, or C," "one or more of A, B, and C," "one or more of A, B, or C," "A, B, and/or C," and "A, B, or C" means A alone, B alone, C alone, A and B together, A and C together, B and C together, or A, B and C together.

The term "a" or "an" entity refers to one or more of that entity. As such, the terms "a" (or "an"), "one or more," and "at least one" can be used interchangeably herein. It is also to be noted that the terms "comprising," "including," and "having" can be used interchangeably.

The term "means" as used herein shall be given its broadest possible interpretation in accordance with 35 U.S.C., Section 112, Paragraph 6. Accordingly, a claim incorporating the term "means" shall cover all structures, materials, or acts set forth herein, and all of the equivalents thereof. Further, the structures, materials or acts and the equivalents thereof shall include all those described in the summary of the invention, brief description of the drawings, detailed description, abstract, and claims themselves.

What is claimed is:

1. A decorative cover frame for completely concealing an appearance of an outlet in a decorated surface, comprising:

a substantially planar body having a decorative element mount surface and an outlet facing surface disposed opposite the decorative element mount surface, wherein the decorative element mount surface includes grooved surface features disposed therein, and wherein an area of the substantially planar body comprises a solid material that completely covers an area of the outlet;

a frame retaining protrusion extending outwardly from the outlet facing surface; and a decorative element support ridge extending outwardly from the decorative element mount surface along peripheral edges of the substantially planar body forming a recessed area disposed inside the peripheral edges of the substantially planar body, wherein the recessed area is configured to receive a decorative element matching a decorative element of the decorated surface.

2. The decorative cover frame of claim 1, wherein the frame retaining protrusion is substantially circular in cross-section.

3. The decorative cover frame of claim 2, wherein the frame retaining protrusion tapers from a first cross-sectional area at the outlet facing surface to a smaller second cross-sectional area at a distance from the outlet facing surface.

4. The decorative cover frame of claim 3, wherein the decorative support ridge and the frame retaining protrusion are integrally formed from the substantially planar body, and wherein the substantially planar body is made from a nonconductive material.

5. The decorative cover frame of claim 4, wherein the nonconductive material is at least partially translucent.

6. The decorative cover frame of claim 4, wherein the frame retaining protrusion includes two separate protrusions, and wherein each protrusion of the two separate protrusions is sized to fit in a corresponding electrical ground port of the outlet.

7. The decorative cover frame of claim 1, further comprising:

a pull tab pivotally interconnected with the decorative cover frame.

8. The decorative cover frame of claim 7, wherein the pull tab is pivotable between a recessed state and an extended state, wherein in the recessed state a portion of the pull tab contacts a portion of the decorative element support ridge, and wherein in the extended state the pull tab pivots in a direction away from the decorative element and the outlet facing surface.

9. The decorative cover frame of claim 1, wherein a pull pin is disposed at least partially within a translation channel disposed within the decorative cover frame, and wherein the pull feature is retained inside the translation channel by a translation stop feature disposed at an end of the translation channel.

10. The decorative cover frame of claim 9, wherein the pull pin comprises a substantially circular head having a rear surface that is offset a first distance from the decorative element mount surface in a recessed state of the pull pin and offset a larger second distance from the decorative element mount surface in an extended state of the pull pin, and wherein first distance provides a gap disposed between the rear surface and a front surface of the decorative element in the recessed state of the pull pin.

11. A decorative cover frame for completely concealing an appearance of an outlet in a decorated surface, comprising:

a substantially planar body having a decorative element mount surface and an outlet facing surface disposed opposite the decorative element mount surface;

a frame retaining protrusion extending outwardly from the outlet facing surface; and a decorative element support ridge extending outwardly from the decorative element mount surface along peripheral edges of the substantially planar body forming a recessed area disposed inside the peripheral edges of the substantially planar body, wherein the recessed area is configured to receive a decorative element matching a decorative element of the decorated surface, and wherein a width of the decorative support ridge is reduced at points where the decorative support ridge meets the decorative element mount surface and at corners of the substantially planar body.

12. The decorative cover frame of claim 11, wherein a first portion of the decorative support ridge is removed from a first peripheral edge of the peripheral edges of the substantially planar body.

13. The decorative cover frame of claim 12, wherein a second portion of the decorative support ridge is removed from a second peripheral edge of the peripheral edges of the substantially planar body, and wherein the second peripheral edge is disposed on an opposite side of the substantially planar body from the first peripheral edge.

14. A method of concealing an outlet in a wall with a decorative concealed outlet device, comprising:

providing a decorative cover frame, comprising:

a substantially planar body having a decorative element mount surface and an outlet facing surface disposed opposite the decorative element mount surface, wherein the decorative element mount surface includes grooved surface features, and wherein an area of the substantially planar body comprises a solid material that completely covers an area of the outlet;

frame retaining protrusions extending outwardly from the outlet facing surface; and a decorative element support ridge extending outwardly from the decorative element mount surface along peripheral edges of the substantially planar body;

applying a layer of adhesive to the decorative element mount surface and the grooved surface features;

attaching decorative tile to the layer of adhesive such that the decorative tile is secured to the decorative cover frame via the layer of adhesive, wherein the decorative cover frame, the layer of adhesive, and the attached decorative tile together form the decorative concealed outlet device;

removing a cover plate from an installed position on the outlet;

fastening an interface plate to the outlet in the installed position on the outlet, wherein the interface plate is a flat plate having a thickness that is less than a thickness of the cover plate, and engaging the frame retaining protrusions of the decorative concealed outlet device with receptacles of the outlet in the wall concealing the outlet and the interface plate from view.

15. The method of claim 14, wherein after fastening the interface plate to the outlet, engaging the frame retaining protrusions of the decorative concealed outlet device with the receptacles of the outlet in the wall comprises disposing the outlet facing surface of the decorative cover frame substantially flush with the wall.

16. The method of claim 14, wherein after fastening the interface plate to the outlet, engaging the frame retaining protrusions of the decorative concealed outlet device with the receptacles of the outlet in the wall comprises disposing the decorative concealed outlet device in contact with the interface plate and the outlet facing surface of the decorative cover frame substantially flush with the wall.

17. The method of claim 14, further comprising:

disengaging the frame retaining protrusions of the decorative concealed outlet device from the receptacles of the outlet in the wall revealing the outlet and receptacles.

* * * * *